US008664173B2

(12) United States Patent
Johnson et al.

(10) Patent No.: US 8,664,173 B2
(45) Date of Patent: Mar. 4, 2014

(54) PREMOISTENED CLEANING DISPOSABLE SUBSTRATE FOR LEATHER AND METHOD OF PRESERVING A LEATHER SURFACE BY CONTACTING SAID SURFACE WITH SAID SUBSTRATE

(75) Inventors: Andress K. Johnson, High Point, NC (US); Stephen E. Minter, Greensboro, NC (US)

(73) Assignee: BASF SE, Ludwigshafen (DE)

( * ) Notice: Subject to any disclaimer, the term of this patent is extended or adjusted under 35 U.S.C. 154(b) by 862 days.

(21) Appl. No.: 11/998,963

(22) Filed: Dec. 3, 2007

(65) Prior Publication Data

US 2008/0171683 A1 Jul. 17, 2008

Related U.S. Application Data

(60) Provisional application No. 60/879,992, filed on Jan. 11, 2007.

(51) Int. Cl.
*C11D 3/36* (2006.01)

(52) U.S. Cl.
USPC ..... 510/275; 510/441; 510/466; 510/189; 510/244; 510/245

(58) Field of Classification Search
USPC ..... 510/466, 189, 244, 245, 268, 275, 441
See application file for complete search history.

(56) References Cited

U.S. PATENT DOCUMENTS

| | | | | | |
|---|---|---|---|---|---|
| 3,494,977 | A | * | 2/1970 | Heit | 525/478 |
| 4,065,258 | A | * | 12/1977 | France | 8/142 |
| 4,279,765 | A | * | 7/1981 | Hill et al. | 510/130 |
| 4,306,990 | A | * | 12/1981 | Goodman et al. | 510/238 |
| 4,495,226 | A | * | 1/1985 | Smith | 427/326 |
| 4,497,919 | A | | 2/1985 | Varga et al. | 524/10 |
| 5,292,581 | A | * | 3/1994 | Viazmensky et al. | 442/408 |
| 5,374,362 | A | | 12/1994 | McFarland | 252/8.6 |
| 5,489,389 | A | * | 2/1996 | Ritter et al. | 252/8.57 |
| 5,658,484 | A | * | 8/1997 | Lohmann et al. | 252/8.57 |
| 5,674,558 | A | | 10/1997 | Speer | 427/140 |
| 5,705,083 | A | * | 1/1998 | Wyss et al. | 252/8.57 |
| 6,093,856 | A | * | 7/2000 | Cripe et al. | 568/625 |
| 6,221,833 | B1 | * | 4/2001 | Colurciello, Jr. | 510/466 |
| 6,503,136 | B1 | | 1/2003 | Rose et al. | 451/533 |
| 7,091,169 | B2 | * | 8/2006 | Nickel et al. | 510/392 |
| 7,309,682 | B2 | * | 12/2007 | Lupia et al. | 510/119 |
| 2002/0020024 | A1 | * | 2/2002 | Schmitz et al. | 8/94.25 |
| 2002/0039985 | A1 | | 4/2002 | Lam | 510/275 |
| 2003/0046769 | A1 | * | 3/2003 | Radomyselski et al. | 8/94.15 |
| 2005/0186170 | A1 | * | 8/2005 | Lupia et al. | 424/70.27 |
| 2005/0210601 | A1 | * | 9/2005 | Strang et al. | 8/141 |
| 2005/0250668 | A1 | * | 11/2005 | Serobian et al. | 510/466 |
| 2006/0040836 | A1 | * | 2/2006 | Lupia et al. | 510/130 |
| 2006/0070189 | A1 | * | 4/2006 | Raehse et al. | 8/115.51 |
| 2006/0276356 | A1 | | 12/2006 | Panandiker et al. | 510/100 |

FOREIGN PATENT DOCUMENTS

| | | |
|---|---|---|
| FR | 2787006 | 6/2000 |
| WO | 00/25731 | 5/2000 |
| WO | 00/68189 | 11/2000 |
| WO | 02/38850 | 5/2002 |
| WO | 2006/130683 | 12/2006 |

OTHER PUBLICATIONS

English language abstract for FR 2787006, Jun. 16, 2000.

* cited by examiner

*Primary Examiner* — Mark Eashoo
*Assistant Examiner* — M. Reza Asdjodi
(74) *Attorney, Agent, or Firm* — Shiela A. Loggins

(57) ABSTRACT

The present invention is directed to a premoistened, disposable, cleaning substrate to improve dirt pick-up and to retard redeposition of the dirt back onto the cleaned leather surface. The said substrate is incorporated therein with a cleaning composition to improve cleaning and impart protection and/or preservation of the leather surface or article. The said substrate is further incorporated therein with UV absorbers to further protect the leather surface, improve appearance and durability. The impregnated substrate can be employed to clean leather surfaces such as furniture, clothing, shoes, belts, automobile upholstery and the like. In addition, a method of preserving a leather surface or article by contacting said surface with said substrate is disclosed.

14 Claims, No Drawings

PREMOISTENED CLEANING DISPOSABLE SUBSTRATE FOR LEATHER AND METHOD OF PRESERVING A LEATHER SURFACE BY CONTACTING SAID SURFACE WITH SAID SUBSTRATE

FIELD OF THE INVENTION

This application claims benefit under 35 USC 119(e) of U.S. Provisional app. No. 60/879,992, filed on Jan. 11, 2007, which is incorporated herein by reference.

The present invention is directed to a premoistened, disposable, cleaning substrate to improve dirt pick-up and to retard redeposition of the dirt back onto the cleaned leather surface. The said substrate is incorporated therein with a cleaning composition to improve cleaning and impart protection and/or preservation of the leather surface or article. The said substrate is further incorporated therein with UV absorbers to further protect the leather surface, improve appearance and durability. The impregnated substrate can be employed to clean leather surfaces such as furniture, clothing, shoes, belts, automobile upholstery and the like. In addition, a method of preserving a leather surface or article by contacting said surface with said substrate is disclosed.

BACKGROUND OF THE INVENTION

Household dirt and soil are usually removed from hard and soft surfaces with a cloth, sponge or other similar hand held implement. To facilitate dirt and soil removal, there are numerous commercially availably surface cleaning compositions in the prior art. Generally, the liquid cleaners consist of some small percentage of surfactant, such as a nonionic, cationic or anionic surfactant, a solvent, such as an alcohol, ammonium hydroxide, a builder, chelating agents, preservatives, biocides and water. A perfume may be added to impart a pleasant fragrance to the cleaner, as well as to mask the unpleasant odor of the solvent and/or surfactant, and, perhaps, a dye to is added impart a pleasant color to the cleaning composition.

Liquid cleaners have limited cleaning efficiency with respect to particular types of soils, and are subject to streaking or redepositing of soil onto the leather surface. The art is in need of techniques and products to improve the cleaning efficiency of cleaning substrates especially with respect to soil and dirt pickup from leather surfaces.

US 2005/0250668 discloses aqueous dispersions of silicone oils, the disclosure of which is incorporated herein by reference.

U.S. Pat. No. 5,374,362 discloses ultraviolet light protection formulae comprising an ultraviolet light indicating dye for use as an indicator, the disclosure of which is incorporated herein by reference.

WO 2000/68189 discloses fluorochemical compounds that are useful as topical oil-repellant treatments for fibrous substrates such as textiles and fabrics.

WO 2002/38850 discloses alkylated fluorochemical oligomers and use thereof in the oil-repellant treatment of fibrous substrates.

U.S. Pat. No. 5,674,558 discloses applying a solvent-borne polyurethane finish as a protectant for leather surfaces, both natural or artificial, the disclosure of which is incorporated herein by reference.

US 2002/0039985 discloses a fragrance-containing cleaning solution, the disclosure of which is incorporated herein by reference.

U.S. Pat. No. 4,497,919 discloses water-in-oil emulsion polish composition, the disclosure of which is incorporated herein by reference.

US 2005/0210601 discloses soil removal devices for leather articles, the disclosure of which is incorporated herein by reference.

WO 2000/25731 discloses formulations for the stabilization of body care and household products which claims priority to U.S. Provisional Appl. No. 60/106,634, the disclosure of which is incorporated herein by reference.

Accordingly, there is still a need for a premoistened cleaning disposable substrate for cleaning leather surfaces with improved cleaning efficacy. There is a further need for such a method of cleaning leather surfaces.

SUMMARY OF THE INVENTION

The present invention is based in part on the discovery that impregnating a disposable substrate with a certain cleaning composition unexpectedly improves the cleaning efficacy of the substrate and prevents ultraviolet light induced degradation of the leather surface.

In another aspect, the invention is directed to a method of cleaning, preserving and protecting a leather surface that comprises the steps of:

a) contacting a leather surface with a premoistened cleaning disposable substrate, said disposable substrate comprises a cleaning composition; and b) applying sufficient force to the disposable substrate to efficiently clean and protect said leather surface.

DETAILED DESCRIPTION OF THE INVENTION

The present invention relates to a premoistened cleaning disposable substrate for cleaning leather surfaces. The premoistened cleaning disposable substrate comprises a) a disposable substrate having incorporated therein an effective cleaning amount of b) a cleaning composition comprising i) from about 0.001% to about 20%, based on weight of the cleaning composition, of a silicone derivative selected from the group consisting of polysiloxane copolymers, silicone-acrylate copolymers, silicone oils, amino-substituted silicone copolymer derivatives, and mixtures thereof;

ii) from about 0.25% to about 25%, based on weight of the cleaning composition, of at least one non-volatile organic solvent;

iii) optionally, from about 0% to about 15%, based on weight of the cleaning composition, of at least one detersive surfactant selected from the group consisting of cationic, zwitterionic, amphoteric, nonionic or mixtures thereof;

iv) from about 0.001% to about 15%, based on weight of the cleaning composition, of at least one cleaning polymer;

v) from about 0.001% to about 10%, based on weight of the cleaning composition, of at least one UV absorber selected from the group consisting of 2H-benzotriazoles, s-triazines, benzophenones, alpha-cyanoacrylates, oxanilides, benzoxazinones, benzoates, alpha-alkyl cinnamates and mixtures thereof;

vi) from about 0.001% to about 15%, based on weight of the cleaning composition, of at least one wetting agent; and vii) balance water;

with the proviso that said cleaning composition is essentially free of carbon-fluorine covalent bonds.

In another aspect, the invention is directed to a method of cleaning, preserving and protecting a leather surface that comprises the steps of:

A) contacting a leather surface with a premoistened cleaning disposable substrate, said disposable substrate having incorporated therein an effective cleaning amount of b) a cleaning composition comprising i) from about 0.001% to about 20%, based on weight of the cleaning composition, of a silicone derivative selected from the group consisting of polysiloxane copolymers, silicone-acrylate copolymers, silicone oils, amino-substituted silicone copolymer derivatives, and mixtures thereof;

ii) from about 0.25% to about 25%, based on weight of the cleaning composition, of at least one non-volatile organic solvent;

iii) optionally, from about 0% to about 15%, based on weight of the cleaning composition, of at least one detersive surfactant selected from the group consisting of cationic, zwitterionic, amphoteric, nonionic or mixtures thereof;

iv) from about 0.001% to about 15%, based on weight of the cleaning composition, of at least one cleaning polymer;

v) from about 0.001% to about 10%, based on weight of the cleaning composition, of at least one UV absorber selected from the group consisting of 2H-benzotriazoles, s-triazines, benzophenones, alpha-cyanoacrylates, oxanilides, benzoxazinones, benzoates, alpha-alkyl cinnamates and mixtures thereof;

vi) from about 0.001% to about 15%, based on weight of the cleaning composition, of at least one wetting agent; and vii) balance water;

with the proviso that the cleaning composition is essentially free of carbon-fluorine covalent bonds; and B) applying sufficient force to the disposable substrate to efficiently clean and protect said leather surface.

The proportions and the ingredients should be selected so that the premoistened disposable substrate is soft enough not to damage the surface of the leather article that is being cleaned, when it is rubbed over the soiled area. The "sufficient force" or rubbing action absorbs the dirt, grease and other soiling elements from the leather article, and is effective for cleaning, particularly for removing greasy spots and perspiration marks. The premoistened disposable substrate should be compounded so that while flexible, pliable and soft, it is cohesive enough so that it does not leave an excessive amount of debris, and is economical in use.

The term "essentially free of" refers to values less than about 0.1 percent based on total weight of the cleaning composition; more preferably to values less than about 0.01 percent based on total weight of the cleaning composition; and, most preferably refers to zero percent based on total weight of the cleaning composition.

The term "effective cleaning amount" means for example the amount necessary to achieve the desired cleaning and/or protecting effect.

The term "leather surface" herein means any leather article that comprises wholly or partially, a material which is composed of an animal hide or skin that is tanned or treated such that the material is imputrescible. Examples of leather articles are grain leather articles and/or suede leather articles.

The leather article described above can be a finished leather article. The term "finished leather article" herein means a leather article which has been processed (for example, finished) in a way that adds value to a consumer (for example, a purchaser of the finished leather article). Nonlimiting examples of finished leather articles include, leather garments (for example, skirts, coats, pants), leather accessories (for example, belts, gloves, bags, purses, shoes), and leather furniture/upholstery (for example, leather chairs, leather sofas).

The term "disposable substrate" of component a) refers to any suitable natural and/or synthetic adsorbent and/or adsorbent material that can be employed to clean hard and soft surfaces by physical contact, e.g, wiping, scrubbing, buffing, polishing, rinsing, and the like. Preferred disposable substrates are non-woven which means that the material is formed without the aid of a textile weaving or knitting process. The non-woven material can comprise, for example, non-woven, fibrous sheet materials or meltblown, coform, air-laid, spun bond, wet laid, bonded-carded web materials, and/or hydroentangled (also known as spunlaced) materials. The disposable substrate can also include wood pulp, a blend of wood pulp, and/or synthetic fibers, e.g., polyester, RAYON, NYLON, polypropylene, polyethylene, and/or cellulose polymers.

The disposable substrate consists of a single-layered structure or is a multilayered laminate-type structure. Alternatively, the disposable substrate may be a wipe article with shear responsive micropockets as described in US 2002/0192268.

The disposable substrate can incorporate a backing member that may be pervious or impervious to a cleaning composition. The backing member provides structural support to the disposable substrate, imparts texture to the disposable substrate, and/or provides a prophylactic barrier. The backing member can be manufactured from any suitable material including, for example, woven or non-woven material, polymeric material, natural fiber, synthetic fiber, or mixtures thereof.

A preferred disposable substrate is manufactured in the form of a general purpose cleaning wipe that has at least one layer of non-woven absorbent or adsorbent material. The wipe can further include wood pulp or a blend of wood pulp and a synthetic fiber, without limitation, such as polyester, RAYON, NYLON, polypropylene, polyethylene, other cellulose polymers; or a synthetic fiber or mixture of such fibers. A binder may or may not be present. Manufacturers include Kimberly-Clark, E.I. du Pont de Nemours and Company, Dexter, American Nonwovens, James River, BBA Nonwovens and PGI. Examples of such substrates are described in U.S. Pat. No. 6,340,663; U.S. Pat. No. 4,781,974; U.S. Pat. No. 4,615,937; U.S. Pat. No. 4,666,621; U.S. Pat. No. 5,908,707; WO 98/03713; WO 97/40814; WO 96/14835; and EP 750,063, all of the US patents are incorporated herein by reference.

Woven or absorbent materials, such as cotton fibers, cotton/nylon blends, or other textiles may also be used in the disposable substrate. Regenerated cellulose, polyurethane foams, and the like, which are used in making sponges, may also be suitable for use herein.

The disposable substrate's liquid loading capacity should be at least about 50% to about 1000% by weight based on the dry weight thereof; more preferably at least about 200% to about 800% of the dry weight thereof; and most preferably at least about 200% to about 500% of the dry weight thereof. This is expressed as loading ½ to 10 times the weight (or, more accurately, the mass) of the disposable substrate. The disposable substrate varies without limitation from about 0.01 to about 1,000 grams per square meter, most preferably 25 to 120 grams/m2 (referred to as "basis weight") and typically is produced as a sheet or web, which is cut, die-cut, or otherwise sized into the appropriate shape and size.

The disposable substrate can be individually sealed with a heat-sealable or glueable thermoplastic overwrap (such as polyethylene, MYLAR, and the like). More preferably the disposable substrate can be packaged as numerous, individual sheets which are then impregnated or contacted with the dirt-attracting polycationic polymer or with a liquid cleaning composition containing the dirt-attracting polycationic polymer. Even more preferably, the disposable substrates can be formed as a continuous web during the manufacturing process and loaded into a dispenser, such as a canister with a closure, or a tub with closure. The closure is to seal the moist wipes from the external environment and to prevent premature volatilization of the liquid ingredients. Without limitation, the dispenser may be formed of plastic, such as high density polyethylene, polypropylene, polycarbonate, polyethylene terepthalate (PET), polyvinyl chloride (PVC), or other rigid plastics. The continuous web of disposable substrate could preferably be threaded through a thin opening in the top of the dispenser, most preferably, through the closure. A means of sizing the desired length or size of the wipe from the web would then be needed. A knife blade, serrated edge, or other means of cutting the web to desired size can be provided on the top of the dispenser, for non-limiting example, with the thin opening actually doubling in duty as a cutting edge. Alternatively, the continuous web of disposable substrates could be scored, folded, segmented, or partially cut into uniform or non-uniform sizes or lengths, which would then obviate the need for a sharp cutting edge. Further, as in hand tissues, the wipes could be interleaved, so that the removal of one wipe advances the next, and so forth.

The disposable substrate will preferably have a certain wet tensile strength which is without limitation about 25 to about 250 Newtons/m, more preferably about 75 to about 170 Newtons/m.

Another preferred disposable substrate is manufactured in the form of clean pads for used in conjunction with handheld implements that are described, for example, in U.S. Pat. No. 6,540,424, which is incorporated herein. As described in U.S. Pat. No. 6,540,424, the disposable substrate consists of a cleaning surface, which comes into direct contact with dirt and debris. This surface comprises an absorbent material which has the ability to absorb fluid, including superabsorbent materials. The disposable substrate preferably has a polyethylene film backing layer that is bonded to the cleaning surface. The film backing layer can be formed of polyethylene or any suitable plastic, rubber, other elastomeric, polymeric or other flexible material.

Suitable materials for the cleaning surface of the disposable substrate are absorbent materials such as the unbonded web material described in U.S. Pat. No. 5,858,112 and U.S. Pat. No. 5,962,112. Other suitable materials are described by U.S. Pat. No. 4,720,415 and superabsorbent materials are described in U.S. Pat. No. 4,995,133; U.S. Pat. No. 5,638,569; U.S. Pat. No. 5,960,508; and U.S. Pat. No. 6,003,191, all of which are incorporated by reference herein.

In a preferred embodiment, the disposable substrate comprises a spunbond fiber non-woven web. The spunbond fibers comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity.

Alternatively, the absorbent material for the disposable substrate comprises a laminate of an air-laid composite and a spunbond fiber nonwoven web. The non-woven web comprises monocomponent spunbond fibers of polypropylene having a basis weight of approximately 14 grams per square meter. The air-laid composite comprises from about 85% to about % kraft pulp fluff and from about 10% to about 15% bicomponent staple fibers. The bicomponent staple fibers have a sheath-core configuration; the core component comprises polyethylene terephthalate and the sheath component comprises polyethylene.

The cleaning composition of component b) i) comprises a silicone derivative selected from the group consisting of polysiloxane copolymers, silicone-acrylate copolymers, silicone oils, amino-substituted silicone derivatives, and mixtures thereof;

The silicone derivative of the cleaning composition of component b) i) can be silicone oils and are distinguished from silicone elastomers and resins, which are more thoroughly cross-linked than silicone oils. Suitable silicone oils include those based on organopolysiloxanes, these being selected from the class of polymers having the general formula (RnSiO((4-n)/2))m (I) wherein n is between 0 and 3 and m is 2 or greater, and R is alkyl or aryl, as defined in Silicone Compounds Register and Review, 5th Edition, R. Anderson, G. L. Larson and C. Smith Eds., Huls America Inc., Piscataway, N.J., p 247 (1991), which is hereby incorporated by reference. The value of m may be as large as one million or more, but more commonly has a value of between about 5 and 1000, these being readily flowable liquids with good handling properties and performance characteristics. These example silicone oils can be linear or branched. Various naming conventions and nomenclature that are essentially equivalent to this exemplary class of silicone oils, include, but are not limited to: dialkylpolysiloxane hydrolyzate; alpha-alkyl-omega-methoxypolydialkylsiloxane; polydialkyl silicone oil; poly(dialkylsiloxane); alkyl end-blocked polydialkylsiloxane; polyoxy(dialkylsilylene), alpha-(trialkylsilyl)-omega-hydroxy; poly[oxy(dialkylsilylene)], alpha-[trialkylsilyl]-omega-[(trialkylsilyl)oxy]; and alpha-(trialkylsilyl) poly[oxy(dialkylsilylene)]-omega-alkyl. Some additional suitable examples also include dimethicone copolyol, dimethylpolysiloxane, diethylpolysiloxane, high molecular weight dimethicone, mixed C1-C30 alkyl polysiloxane, phenyl dimethicone, dimethiconol, and mixtures thereof. Non-limiting examples of silicone oils useful herein are also described in U.S. Pat. No. 5,011,681, to Ciotti et al., which is hereby incorporated by reference.

The silicone derivative of the cleaning composition of component b) i) can be polysiloxane copolymers. The polysiloxane copolymers useful herein also include polyalkyl or polyaryl siloxanes. The alkyl or aryl groups substituted on the siloxane chain (R) or at the ends of the siloxane chains can have any structure as long as the resulting silicone remains fluid at or around room temperature. Suitable R groups include hydroxy, methyl, methoxy, ethyl, ethoxy, propyl, propoxy, phenyl, methylphenyl, phenylphenyl, aryl and aryloxy. One or more R groups on the silicon atom may represent the same group or different groups, or any combination thereof. Suitable silicone compounds are polydimethylsiloxane, polydiethylsiloxane, and polymethylphenylsiloxane. Polydimethylsiloxane, which is also known as dimethicone, is suitable and readily available in many forms and grades, including for example, edible grades suitable for use in compositions for food contact usage. The polyalkylsiloxanes that can be used include, for example, polydimethylsiloxanes. These silicone compounds are available, for example, from the General Electric Company in their Viscasil® and SF 96 series, and from Dow Corning in their Dow Corning 200 series. Polyalkylaryl siloxane fluids containing one or more alkyl or alkylaryl substituents can also be used, for example, and include, but are not limited to polymethylphenylsiloxanes, poly[(dimethylsiloxane)/(methylviny-Isiloxane)], poly[(dimethylsiloxane)/(diphenylsiloxane)], poly[(dimethylsiloxane)/(phenylmethylsiloxane)], and poly[(dimethylsiloxane)/(diphenylsiloxane)/(methylvinylsiloxane)]. These siloxanes are available, for example, from the General Electric Company as SF 1075 methyl phenyl fluid or from Dow Corning as 556 Cosmetic Grade Fluid, RHODORSIL 763 from Rhne-Poulenc, SILBIONE 70641 V 30 and 70641 V 200 from Rhone-Poulenc, the silicones of the PK series from Bayer, such as PK20, the silicones of the PN and PH series from Bayer, such as PN 1000 and PH 1000, and certain oils of the SF series from General Electric, such as SF 1250, SF 1265, SF 1154 and SF 1023.

Higher molecular weight silicone derivatives, including silicone gums and resins, may be used in accordance with the present invention and include polydiorganosiloxanes with a molecular mass of between 200,000 and 5,000,000, used alone or as a mixture in a solvent chosen from volatile silicones, polydimethylsiloxane (PDMS) oils, polyphenylmethylsiloxane (PPMS) oils, isoparaffins, methylene chloride, pentane, dodecane, tridecane and tetradecane, or mixtures thereof.

The silicone derivatives can be linear or branched, and can be modified by chemical groups to provide additional properties. For example, suitable silicone derivatives also include the amino-substituted silicone derivatives, wherein R is an amine, amide or alkyl, dialkyl or trialkyl derivatized amine constituent. By substitution of one or more of the R groups with other organic or functionalized organic groups, such as vinyl, phenyl, carboxylic acid derivatives, carboxyester and quaternary ammonium derivatives, other organopolysiloxanes can be produced. Included are mixtures of these materials, for example, but not limited to: 1) mixtures formed from a polydimethylsiloxane hydroxylated at the end of the chain (Dimethiconol according to the CTFA nomenclature) and from a cyclic polydimethylsiloxane (Cyclomethicone according to the CTFA nomenclature), such as the product Q2 1401 sold by the company Dow Corning; 2) mixtures formed from a polydimethylsiloxane gum with a cyclic silicone, such as the product SF 1214 Silicone Fluid from General Electric, which is an SE 30 gum of MW 500,000 dissolved in SF 1202 Silicone Fluid (decamethylcyclopentasiloxane); 3) mixtures of two PDMS materials of different viscosities, for example a PDMS gum and a PDMS oil, such as the products SF 1236 and CF 1241 from the company General Electric. The product "SF 1236" is a mixture of an SE 30 gum defined above, with a viscosity of 20 m2/s, and of an SF 96 oil with a viscosity of $5\times10^{-5}$ m2/s (15% SE 30 gum and 85% SF 96 oil). The product "CF 1241" is a mixture of an SE 30 gum (33%) and of a PDMS (67%) with a viscosity of $10^{-2}$ m2/s. The organomodified silicones in accordance with the present invention are silicones as defined above, containing in their general structure one or more organofunctional groups directly attached to the siloxane chain or attached via a hydrocarbon-based radical. Examples include silicones containing: a) polyethyleneoxy and/or polypropyleneoxy groups, optionally containing alkyl groups, such as: the product known as dimethicone copolyol sold by the company Dow Corning under the name "DC 1248", and alkyl (C12) methicone copolyol sold by the company Dow Corning under the name "Q2 5200", the oils "SILWET" L 722, L 7500, L 77 and L 711 from the company General Electric, the mixture of dimethicone copolyol and of cyclomethicone, such as the product sold under the name "Q2-3225C" by the company Dow Corning; the product "MIRASIL DMCO" sold by Rhone-Poulenc; b) hydroxyacylamino groups, such as those described in European patent application EP-A-0,342,834, and in particular the silicone sold by the company Dow Corning under the name "Q2-8413"; c) thiol groups, such as in the silicones "X 2-8360" from Dow Corning or "GP 72A" and "GP 71" from Genesee; Union Carbide or the silicone known as "Amodimethicone" in the CTFA dictionary; d) carboxylate groups, such as the products described in European patent EP 186,507 from Chisso Corporation, which is hereby incorporated by reference; e) hydroxylated groups, such as the polyorganosiloxanes containing a hydroxyalkyl function, described in patent application FR-A-2,589,476, which is hereby incorporated by reference, and in particular polyorganosiloxanes containing a .gamma.-hydroxy-propyl function; f) alkoxylated groups containing at least 12 carbon atoms, such as the product "Silicone Copolymer F 7551" from SWS Silicones and the products "ABILWAX 2428", "ABILWAX 2434" and "ABILWAX 2440" from the company Goldschmidt; g) acyloxyalkyl groups containing at least 12 carbon atoms, such as, for example, the poly-organosiloxanes described in patent application FR-A-2,641,185, which is hereby incorporated by reference, and in particular polyorganosiloxanes containing a stearoyloxypropyl function; h) quaternary ammonium groups, such as in the products "X2 81 08" and "X2 81 09" and the product "ABIL K 3270" from the company Goldschmidt; i) amphoteric or betaine groups, such as in the product sold by the company Goldschmidt under the name "ABIL B 9950"; and j) bisulphite groups, such as in the products sold by the company Goldschmidt under the names "ABIL S 201" and "ABIL S 255". The block copolymers having a polysiloxane-polyoxyalkylene linear block as repeating unit, which are used in the context of the present invention, include those have the following general formula: ([Y(R2SiO)aR'2SiYO][CnH2nO—)b])c (II) in which R and R', which may be identical or different, represent a monovalent hydrocarbon-based radical containing no aliphatic unsaturation, n is an integer ranging from 2 to 4, a is an integer greater than or equal to 5, particularly between 5 and 200 and even more particularly between 5 and 100, b is an integer greater than or equal to 4, particularly between 4 and 200 and even more particularly between 5 and 100, c is an integer greater than or equal to 4, particularly between 4 and 1000 and even more particularly between 5 and 300, Y represents a divalent organic group which is linked to the adjacent silicon atom via a carbon-silicon bond and to a polyoxyalkylene block via an oxygen atom, the average molecular weight of each siloxane block is between about 400 and about 10,000, that of each polyoxyalkylene block being between about 300 and about 10,000, the siloxane blocks represent from about 10% to about 95% of the weight of the block copolymer, the average molecular weight of the block copolymer being at least 3000 and particularly between 5000 and 1,000,000 and even more particularly between 10,000 and 200,000. R and R' are suitably chosen from the group comprising alkyl radicals such as, for example, the methyl, ethyl, propyl, butyl, pentyl, hexyl, octyl, decyl and dodecyl radicals, aryl radicals such as, for example, phenyl and naphthyl, arylalkyl radicals such as, for example, benzyl and phenethyl, and tolyl, xylyl and cyclohexyl radicals. Y is suitably selected from radicals including —R"—, —R"—CO—, —R"—NHCO—, —R"—NH—CO—NH—R"—NHCO or —R"—OCONH—R'"—NHCO—, where R" is a divalent alkylene group such as, for example, ethylene, propylene or butylene, and R'" is a divalent alkylene group or a divalent arylene group such as —C6H4, —C6H4C6H4-, C6H4-CH2-C6H4, C6H4-C(CH3)2C6H4. Even more particularly, Y represents a divalent alkylene radical, more particularly the —CH2-CH2-CH2- radical or the —C4H8- radical. The preparation of the block copolymers used in the context of the present invention is described in European application EP 0,492,657 A1, which is hereby incorporated by reference.

Also suitable are the use of one or more volatile silicone oils, that is silicone oils with sufficient vapor pressure or volatility sufficient to at least partially or completely evaporate into the atmosphere during and/or after application of the inventive compositions onto a leather surface. The inventive compositions may in one embodiment contain solely a volatile silicone fluid as the silicone oil, or in an alternative embodiment may optionally contain one or more volatile silicone fluids in combination, or in yet another embodiment may optionally contain one or more volatile and one or more non-volatile silicone fluids in combination. Volatile silicone oils generally are low viscosity silicone fluids with an appreciable vapor pressure at ambient temperatures. Generally, the volatile silicone fluids useful in the present invention have a viscosity of less than about 10 centistokes at 25C and optionally less than about 5 centistokes at 25C.

Suitable volatile silicone oils include the polydimethylcyclosiloxanes. Polydimethylcyclosiloxane fluids useful in the present invention can be defined by the general formula [(CH3)2 SiO]x where x has a value from three to eight. Generally, the polydimethylcyclosiloxane fluid useful in the present invention is a mixture of one or more of the various species represented by the above formula. The commercial polydimethylcyclosiloxanes are mixtures of the various species represented by the above formula and are considered within the scope of the present invention. Some suitable polydimethylcyclosiloxane fluids for use in this invention are those where octamethylcyclotetrasiloxane, decamethylcyclopentasiloxane, and dodecamethylcyclohexasiloxane (i.e. where x is from 4 to 6) predominate. The fluids where decamethylcyclopentasiloxane and dodecamethylcyclohexasiloxane predominate are particularly suited. In accordance with another embodiment, those volatile silicone fluids manufactured by Dow Corning™ Corporation are used. It is believed that Dow Corning 245 and 345 volatile silicone fluids primarily consist of decamethylcyclopentasil-oxane with lesser amounts of dodecamethylcyclohexasiloxane and minor amounts of octamethylcyclotetrasiloxane. Other suitable volatile silicones include "DC 244", "DC 245", "DC 246", "DC 344", "DC 345", and "DC 346", (manufactured by Dow Corning); SILICONE 7207 and SILICONE 7158 (manufactured by the Union Carbide Corp.); SF 1202 (manufactured by General Electric); and SWS-03314 (manufactured by SWS Silicones, Inc.).

Also suitable for use, and particularly in combination with other silicone oils, are the modified silicone derivatives described below. Examples also include, but are not limited to, polyalkyleneoxide modified polydimethylsiloxane, available from General Electric as SILWET 7650, polyalkyleneoxide modified heptamethyltrisiloxane, also available from General Electric as SILWET 7280 and SILWET 7608, silicone glycol copolymer surfactant, available from Dow Corning as DC 57 and the Dow Corning silicone polyether surfactant designated Q2-5211. Additional examples include, but not limited to, alkyl methyl siloxanes DC 56 available from Dow Corning and organomodified dimethylsiloxane available from General Electric designated as FORMASIL 433.

The silicone derivative of the cleaning composition of component b) i) can be silicone-acrylate copolymers. The silicone portion of this copolymer constitutes from about 10% to about 95%, based on the total weight of the copolymer. In another embodiment of the instant invention, the silicone portion of this copolymer constitutes from about 20% to about 65%, based on the total weight of the copolymer. In another embodiment of the instant invention, the silicone portion of this copolymer constitutes from about 20% to about 35%, based on the total weight of the copolymer. The silicone portion of the copolymer is composed of from about 88% to about 97%, preferably 92 to 97 mole percent of dimethylsiloxane units and from about 3% to about 12%, preferably from about 3% to about 8% mole percent of methylvinylsiloxane units. The remaining 5% to about 95% based on weight of the silicone-acrylate copolymer, preferably about 35% to about 80%, and more preferably about 65% to about 80% is composed of the acrylate portion. The acrylate portion is an acrylate monomer selected from the group consisting of ethyl acrylate, methyl acrylate, acrylic acid, ethyl methacrylate, methyl methacrylate, methacrylic acid, and acrylonitrile.

The silicone-acrylate copolymers employed in the instant invention may be prepared by emulsion polymerization. Suitable emulsion polymerization processes for preparing these copolymers are set forth in French Patent No. 1,491,782. Essentially, in the preferred embodiment, the process of preparing the copolymer involves the polymerization of the siloxane portion in the emulsion first, the subsequently adding thereto the appropriate acrylate monomer(s) and copolymerizing the silicone and acrylate monomers in the emulsion. Alternatively, the silicone and acrylate monomers can be emulsified together and then the silicone monomers polymerized first and then subsequently adding a catalyst and causing polymerization of the resulting siloxane and the acrylate monomers to form the desired silicone-acrylate copolymer.

Mixtures and combinations of any of the silicone derivatives of component b) i) exampled herein, for example, silicone oils having different molecular weights, different viscosities, different functionalized derivatives, different volatilities and/or vapor pressures, different properties and benefits, and combinations thereof, may advantageously be combined in the cleaning compositions of the present invention. For example, a "lighter" or lower viscosity polyorganosiloxane can be combined with a "heavier" or higher viscosity silicone oil, and/or a silicone gum and/or silicone elastomer for purposes of dispersion in the compositions of the present invention, wherein the "heavier" materials would otherwise be difficult to handle and disperse if used solely or in combinations without a "lighter" silicone included. Alternatively, a volatile silicone oil may be combined with a less volatile or essentially non-volatile silicone oil.

The silicone derivatives of component b) i) are also useful for imparting a shine or glossy coating to the treated surfaces, resulting in enhanced appearance and other aesthetic benefits associated with modification of incident light, such as refractive and diffusive contributions to specular reflections that contribute to the perception of enhanced color and tone, and decreased perception of surface defects such as scratches, stress cracks, striations, and other surface defects that commonly develop on surfaces with normal age and wear. Hence, the silicone derivatives of component b) i) are useful for their restorative effect when used on aged and worn leather surfaces.

Another embodiment of the instant invention is a mixture of a polysiloxane copolymer and an amino-substituted silicone copolymer as the components of b) i). The polysiloxane copolymer of the mixture is depicted in formula (III)

(III)

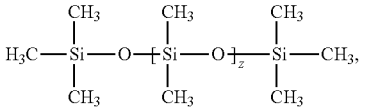

wherein z is an integer from 1 to about 5000; and the amino-substituted silicone copolymer of the mixture is depicted in formula (IV)

(IV)

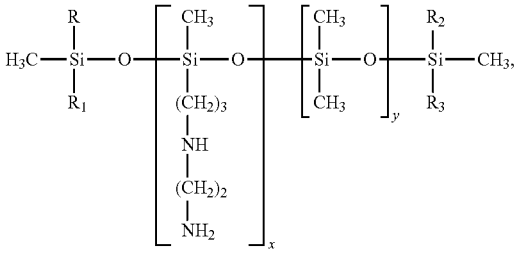

wherein

R, $R_1$, $R_2$ and $R_3$ independently from each other are $CH_3$, OH or $OC_1$-$C_4$alkyl, x is an integer from 1 to 2000, and y is an integer from 1 to 2000.

Another embodiment of the instant invention is a mixture of a polysiloxane copolymer and an amino-substituted silicone copolymer as the components of b) i). The polysiloxane copolymer of the mixture is depicted in formula (III)

(III)

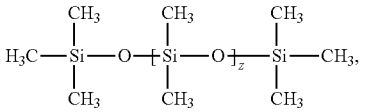

wherein z is an integer from 1 to about 2000; and the amino-substituted silicone copolymer of the mixture is depicted in formula (IV)

(IV)

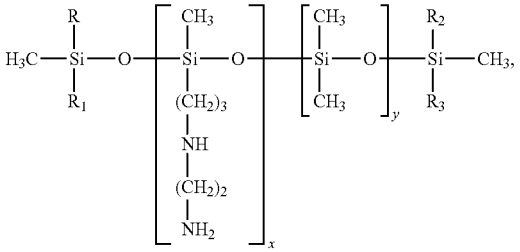

wherein

R, $R_1$, $R_2$ and $R_3$ independently from each other are $CH_3$, OH or $OC_1$-$C_4$alkyl, x is an integer from 1 to 200, and y is an integer from 1 to 500.

Another embodiment of the instant invention is a mixture of a polysiloxane copolymer and an amino-substituted silicone copolymer as the components of b) i). The polysiloxane copolymer of the mixture is depicted in formula (III)

(III)

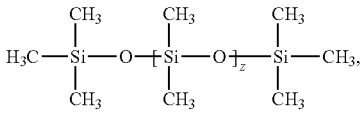

wherein z is an integer from 10 to about 500; and the amino-substituted silicone copolymer of the mixture is depicted in formula (IV)

(IV)

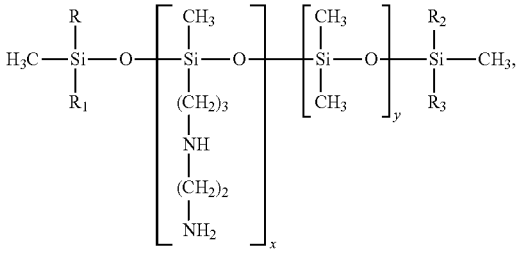

wherein

R, $R_1$, $R_2$ and $R_3$ independently from each other are $CH_3$, OH or $OC_1$-$C_4$alkyl, x is an integer from 1 to 100, and y is an integer from 10 to 300.

Another embodiment of the instant invention is a mixture of a polysiloxane copolymer and an amino-substituted silicone copolymer as the components of b) i), wherein the amino-substituted silicone copolymer of the mixture is depicted in formula (IV)

(IV)

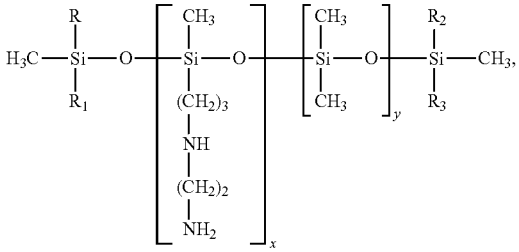

wherein

R, $R_1$, $R_2$ and $R_3$ are $CH_3$, and x and y are integers as depicted above.

Another embodiment of the instant invention is a molecular weight for the compound of formula (III) is from about 200 to about 200,000 Daltons.

Another embodiment of the instant invention is a molecular weight of the compound of formula (III) is from about 500 to about 150,000 Daltons.

Another embodiment of the instant invention is a molecular weight of the compound of formula (III) is from about 1000 to about 100,000 Daltons.

Another embodiment of the instant invention is a molecular weight of the compound of formula (IV) is from about 200 to about 200,000 Daltons.

Another embodiment of the instant invention is a molecular weight of the compound of formula (IV) is from about 500 to about 150,000 Daltons.

Another embodiment of the instant invention is a molecular weight of the compound of formula (IV) is from about 1000 to about 100,000 Daltons.

In suitable embodiments, the silicone derivative of component b) i) comprises 0.001% by weight to about 20% by weight, or 0.01% by weight to about 10% by weight, or alternatively 0.1% by weight to about 5% by weight of the inventive composition, or alternatively 0.1% by weight to about 3% by weight of the inventive composition.

The cleaning compositions can also include as component b) ii) one or more non-volatile organic solvents at effective levels. For the purpose of this patent, the non-volatile organic solvent has a vapor pressure of less than about 0.1 mm of mercury at 20C. or has a boiling point of at least about 230C.

Due to their low volatility, these solvents tend not to evaporate rapidly and allow sufficient "working" time for the wipe before it dries out. Preferred solvents are esters and glycol ethers. The most preferred solvents are glycol ethers of high boiling point.

Such solvents typically have a terminal C3-C6 hydrocarbon attached to from two to three alkylene glycol moieties to provide the appropriate degree of hydrophobicity, high boiling point (or low vapor pressure) and, preferably, surface activity. Examples of commercially available hydrophobic cleaning solvents based on alkylene glycol chemistry include Triethyleneglycol monomethyl ether (Methoxytriglycol ether from Dow Chemicals), Diethylene glycol monoethyl ether (Carbitol Solvent from Dow Chemicals), Triethyleneglylcol monoethyl ether (Ethoxytriglycol from Dow Chemicals), diethyleneglycol butylether (Butyl Carbitol), Triethyleneglycol monobutyl ether (Butoxytriglycol ether), Diethyleneglycol monohexyl ether (Hexyl Carbitol), ethylene glycol phenyl ether (DOWANOL EPh), Dipropyleneglycol methyl ether (DOWANOL DPM), Tripropylene glycol methyl ether (DOWANOL TPM), Dipropylene glycol methylether acetate (DOWANOL DPMA), Dipropylene glycol n Propyl ether (DOWANOL DPnP), Tripropyleneglycol n propyl ether (DOWANOL TPnP), dipropyleneglycol n-butyl ether (DOWANOL DPnB), Tripropylene glycol n-butyl ether (DOWANOL TPnB), Propyleneglycol phenyl ether (DOWANOL PPh). These solvents are commercially available from Dow Chemicals (1691 N. Swede Road, Midland, Mich.).

Additional solvents of this class are available from Clariant GmbH of Werk Gendorf, Germany. Examples include Methyl tetraglycol (from Clariant GmbH), and buyl polyglycol (from Clariant GmbH).

Other suitable solvents include but are not limited to alkyl pyrrolidone or d-limonine.

The non-volatile organic solvents of component b) ii) are effective at levels of, typically from about 0.25% to about 25% by weight of the cleaning composition, or from about 0.5% to about 20% by weight of the cleaning composition, or from about 0.5% to about 10% by weight of the cleaning composition, or from about 1% to about 5%, by weight of the cleaning composition.

Detersive surfactants of component b) iii) of the cleaning composition are selected from the group consisting of cationic, zwitterionic, amphoteric, nonionic and mixtures thereof. Detergent surfactants useful herein are described in U.S. Pat. No. 3,664,961; U.S. Pat. No. 3,919,678; U.S. Pat. No. 4,222,905; and in U.S. Pat. No. 4,239,659. All of these patents are incorporated herein by reference.

Suitable cationic surfactants to be used herein include the quaternary ammonium surfactants. The quaternary ammonium surfactant may be a mono C6-C24, or a C6-C24 N-alkyl or alkenyl ammonium surfactant wherein the remaining N positions are substituted by methyl, hydroxyethyl or hydroxypropyl groups. Suitable are also the mono-alkoxylated and bis-alkoxylated amine surfactants.

Another suitable group of cationic surfactants, which can be used in the inventive compositions, are cationic ester surfactants. The cationic ester surfactant is a compound having surfactant properties comprising at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529, all of which are hereby incorporated by reference. The ester linkage and cationically charged group may be separated from each other in the surfactant molecule by a spacer group consisting of a chain comprising at least three atoms (i.e. of three atoms chain length), or from three to eight atoms, or from three to five atoms, or three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —CH2-O—, CH2- and —CH2-NH—CH2- linkages are included. The spacer group chain may comprise only carbon atoms, or the chain may be hydrocarbyl chain.

The inventive cleaning composition may comprise cationic mono-alkoxylated amine surfactants, for instance, of the general formula: R1R2R3N+ApR4X− wherein R1 is an alkyl or alkenyl moiety containing from about 6 to about 18 carbon atoms, or from 6 to about 16 carbon atoms, or from about 6 to about 14 carbon atoms; R2 and R3 are each independently alkyl groups containing from one to about three carbon atoms, for instance, methyl, for instance, both R2 and R3 are methyl groups; R4 is selected from hydrogen, methyl and ethyl; X− is an anion such as chloride, bromide, methylsulfate, sulfate, or the like, to provide electrical neutrality; A is a alkoxy group, especially a ethoxy, propoxy or butoxy group; and p is from 0 to about 30, or from 2 to about 15, or from 2 to about 8. The ApR4 group in the formula may have p=1 and is a hydroxyalkyl group, having no greater than 6 carbon atoms whereby the —OH group is separated from the quaternary ammonium nitrogen atom by no more than 3 carbon atoms. Suitable ApR4 groups are —CH2CH2-OH, —CH2CH2CH2-OH, —CH2CH(CH3)-OH and —CH(CH3)CH2-OH. Suitable R1 groups are linear alkyl groups, for instance, linear R1 groups having from 8 to 14 carbon atoms.

Suitable cationic mono-alkoxylated amine surfactants for use herein are of the formula R1(CH3)(CH3)N+(CH2CH2O).- 2-5H X− wherein R1 is C10-C18 hydrocarbyl and mixtures thereof, especially C10-C14 alkyl, or C10 and C12 alkyl, and X is any convenient anion to provide charge balance, for instance, chloride or bromide. As noted, compounds of the foregoing type include those wherein the ethoxy (CH2CH2O) units (EO) are replaced by butoxy, isopropoxy [CH(CH3)CH2O] and [CH2CH(CH3)O] units (i-Pr) or n-propoxy units (Pr), or mixtures of EO and/or Pr and/or i-Pr units.

The cationic bis-alkoxylated amine surfactant may have the general formula: R1R2N+ApR3A'qR4X− wherein R1 is an alkyl or alkenyl moiety containing from about 8 to about 18 carbon atoms, or from 10 to about 16 carbon atoms, or from about 10 to about 14 carbon atoms; R2 is an alkyl group containing from one to three carbon atoms, for instance, methyl; R3 and R4 can vary independently and are selected from hydrogen, methyl and ethyl, X− is an anion such as chloride, bromide, methylsulfate, sulfate, or the like, sufficient to provide electrical neutrality. A and A' can vary independently and are each selected from C1-C4 alkoxy, for instance, ethoxy, (i.e., —CH2CH2O—), propoxy, butoxy and mixtures thereof, p is from 1 to about 30, or from 1 to about 4 and q is from 1 to about 30, or from 1 to about 4, or both p and q are 1.

Suitable cationic bis-alkoxylated amine surfactants for use herein are of the formula R1CH3N+(CH2CH2OH)(CH2CH2OH)X−, wherein R1 is C10-C18 hydrocarbyl and mixtures thereof, or C10, C12, C14 alkyl and mixtures thereof, X.sup.− is any convenient anion to provide charge balance, for example, chloride. With reference to the general cationic bis-alkoxylated amine structure noted above, since in one example compound R1 is derived from (coconut) C12-C14 alkyl fraction fatty acids, R2 is methyl and ApR3 and A'qR4 are each monoethoxy.

Other cationic bis-alkoxylated amine surfactants useful herein include compounds of the formula: R1R2N+(CH2CH2O)pH—(CH2CH2O)qHX− wherein R1 is C10-C18 hydrocarbyl, or C10-C14 alkyl, independently p is 1 to about 3 and q is 1 to about 3, R2 is C1-C3 alkyl, for example, methyl, and X− is an anion, for example, chloride or bromide. Other compounds of the foregoing type include those wherein the ethoxy (CH2CH2O) units (EO) are replaced by butoxy (Bu) isopropoxy [CH(CH3)CH2O] and [CH2CH(CH3)O] units (i-Pr) or n-propoxy units (Pr), or mixtures of EO and/or Pr and/or i-Pr units.

Non-limiting examples of nonionic surfactants include: a) C12-C18 alkyl ethoxylates, such as, NEODOL® nonionic surfactants from Shell; b) C6-C12 alkyl phenol alkoxylates wherein the alkoxylate units are a mixture of ethyleneoxy and propyleneoxy units; c) C12-C18 alcohol and C6-C12 alkyl phenol condensates with ethylene oxide/propylene oxide block polymers such as Pluronic® from BASF; d) C14-C22 mid-chain branched alcohols, BA, as disclosed in U.S. Pat. No. 6,150,322; e) C14-C22 mid-chain branched alkyl alkoxylates, BAEx, wherein x 1-30, as disclosed in U.S. Pat. Nos. 6,153,577, 6,020,303, and 6,093,856; f) alkyl polysaccharides as disclosed in U.S. Pat. No. 4,565,647; specifically alkylpolyglycosides as disclosed in U.S. Pat. Nos. 4,483,780 and 4,483,779; g) Polyhydroxy fatty acid amides as disclosed in U.S. Pat. No. 5,332,528, WO 92/06162, WO 93/19146, WO 93/19038, and WO 94/09099; h) ether capped poly(oxyalkylated) alcohol surfactants as disclosed in U.S. Pat. No. 6,482,994 and WO 01/42408; and i) amine oxides.

Examples of surfactants for use herein are the alkylpolysaccharides that are disclosed in U.S. Pat. No. 5,776,872; U.S. Pat. No. 5,883,059; U.S. Pat. No. 5,883,062; and U.S. Pat. No. 5,906,973.

Suitable alkylpolysaccharides for use herein are disclosed in U.S. Pat. No. 4,565,647, having a hydrophobic group containing from about 6 to about 30 carbon atoms, preferably from about 10 to about 16 carbon atoms and a polysaccharide, e.g., a polyglycoside, hydrophilic group. For acidic or alkaline cleaning compositions/solutions suitable for use in no-rinse methods, the preferred alkyl polysaccharide preferably comprises a broad distribution of chain lengths, as these provide the best combination of wetting, cleaning, and low residue upon drying. This "broad distribution" is defined by at least about 50% of the chainlength mixture comprising from about 10 carbon atoms to about 16 carbon atoms. Preferably, the alkyl group of the alkyl polysaccharide consists of a mixtures of chainlength, preferably from about 6 to about 18 carbon atoms, more preferably from about 8 to about 16 carbon atoms, and hydrophilic group containing from about one to about 1.5 saccharide, preferably glucoside, groups per molecule. This "broad chainlength distribution" is defined by at least about 50% of the chainlength mixture comprising from about 10 carbon atoms to about 16 carbon atoms. A broad mixture of chain lengths, particularly C8-C16, is highly desirable relative to narrower range chain length mixtures, and particularly versus lower (i.e., C8-C10 or C8-C12) chainlength alkyl polyglucoside mixtures. It is also found that the preferred C8-C16 alkyl polyglucoside provides much improved perfume solubility versus lower and narrower chainlength alkyl polyglucosides, as well as other preferred surfactants, including the C8-C14 alkyl ethoxylates. Any reducing saccharide containing 5 or 6 carbon atoms can be used, e.g., glucose, galactose and galactosyl moieties can be substituted for the glucosyl moieties. (optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units. The glycosyl is preferably derived from glucose.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides and/or galatoses. Suitable mixtures include coconut alkyl, di-, tri-, tetra-, and pentaglucosides and tallow alkyl tetra-, penta- and hexaglucosides.

To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

In the alkyl polyglycosides, the alkyl moieties can be derived from the usual sources like fats, oils or chemically produced alcohols while their sugar moieties are created from hydrolyzed polysaccharides. Alkyl polyglycosides are the condensation product of fatty alcohol and sugars like glucose with the number of glucose units defining the relative hydrophilicity. As discussed above, the sugar units can additionally be alkoxylated either before or after reaction with the fatty alcohols. Such alkyl polyglycosides are described in detail in WO 86/05199 for example. Technical alkyl polyglycosides are generally not molecularly uniform products, but represent mixtures of alkyl groups and mixtures of monosaccharides and different oligosaccharides. Alkyl polyglycosides (also sometimes referred to as "APG's") are preferred for the purposes of the invention since they provide additional improvement in surface appearance of the surface being cleaned relative to other surfactants. The glycoside moieties are preferably glucose moieties. The alkyl substituent is preferably a saturated or unsaturated alkyl moiety containing from about 8 to about 18 carbon atoms, preferably from about 8 to about 10 carbon atoms or a mixture of such alkyl moieties. C8-C16 alkyl polyglucosides are commercially available (e.g., Simusol® surfactants from Seppic Corporation, 75 Quai d'Orsay, 75321 Paris, Cedex 7, France, and Glucopon®425 available from Henkel). In the present invention, the preferred alkyl polyglucosides are those which have been purified enough for use in personal cleansing. Most preferred are "cosmetic grade" alkyl polyglucosides, particularly C8 to C16 alkyl polyglucosides, such as Plantaren 2000®, Plantaren 2000 N®, and Plantaren 2000 N UP®, available from Henkel Corporation (Posffach 1101100, D 40191 Dusseldorf, Germany). Examples are N-methyl N-1-deoxyglucityl cocoamide and N-methyl N-1-deoxyglucityl oleamide. Processes for making polyhydroxy fatty acid amides are known and can be found in U.S. Pat. No. 2,965,576 and U.S. Pat. No. 2,703,798.

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 column 19, line 38 through column 22, line 48, for examples of zwitterionic surfactants; betaine, including alkyl dimethyl betaine and cocodimethyl amidopropyl betaine, C8 to C18 (preferably C12 to C18) amine oxides and sulfo and hydroxy betaines, such as N-alkyl-N,N-dimethylammino-1-propane sulfonate where the alkyl group can be C8 to C18, preferably C10 to C14.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 column 19, lines 18-35, for examples of ampholytic surfactants.

Nonlimiting examples of anionic surfactants useful herein include: a) C11-C18 alkyl benzene sulfonates (LAS); b) C10-C20 primary, branched-chain and random alkyl sulfates (AS); c) C10-C18 secondary (2,3) alkyl sulfates; d) C10-C18 alkyl alkoxy sulfates (AExS) wherein preferably x is from 1-30; e) C10-C18 alkyl alkoxy carboxylates preferably comprising 1-5 ethoxy units; f) mid-chain branched alkyl sulfates as disclosed in U.S. Pat. Nos. 6,020,303 and 6,060,443; g) mid-chain branched alkyl alkoxy sulfates as disclosed in U.S. Pat. Nos. 6,008,181 and 6,020,303; h) modified alkylbenzene sulfonate (MLAS) as disclosed in: WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Non-limiting examples of cationic surfactants include: the quaternary ammonium surfactants, which can have up to 26 carbon atoms; a) alkoxylate quaternary ammonium (AQA) surfactants as disclosed in U.S. Pat. No. 6,136,769; b) dimethyl hydroxyethyl quaternary ammonium as disclosed in U.S. Pat. No. 6,004,922; c) polyamine cationic surfactants as disclosed in WO 98/35002, WO 98/35003, WO 98/35004, WO 98/35005, and WO 98/35006; d) cationic ester surfactants as disclosed in U.S. Pat. Nos. 4,228,042, 4,239,660 4,260,529 and 6,022,844; e) amino surfactants as disclosed in U.S. Pat. No. 6,221,825 and WO 00/47708, specifically amido propyldimethyl amine; and f) ethoxylated and propoxylated quaternary ammonium compounds.

Non-limiting examples of semi-polar nonionic surfactants include: water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms. See WO 01/32816, U.S. Pat. No. 4,681,704, and U.S. Pat. No. 4,133,779.

The detersive surfactant(s) of component b) iii) of the cleaning composition herein may comprise, optionally, from about 0% to 15% based on weight of the cleaning composition. Preferably such cleaning compositions comprise from about 0.01% to 10%, based on weight of the cleaning composition, of the detersive surfactant. More preferably such cleaning compositions comprise from about 0.01% to 5%, based on weight of the cleaning composition, of the detersive surfactant. Even more preferably such cleaning compositions comprise from about 0.01% to 1%, based on the weight of the cleaning composition, of the detersive surfactant.

The inventive cleaning composition herein comprises cleaning polymers of component b) iv). Also suitable are cleaning polymers that provide a dual benefit to the inventive compositions in that they provide for compositions exhibiting the desired rheological Critical Strain Value and Elastic Modulus Value parameters, in addition to the cleaning benefit. An exemplary secondary benefit is surface modification of the surfaces treated with the inventive compositions, whereby the surface is modified to exhibit a property such as enhanced hydrophilicity, hydrophobicity, anti-soiling, water and/or stain repellency, reduced friction, increased lubricity, softness, anti-static and/or charge dissipative properties, reduced dust and/or lint retention, and the combinations of these properties and/or benefits.

In suitable embodiments of the invention, the cleaning polymer that improves the hydrophilicity of the surface being treated is incorporated into the present cleaning compositions. The increase in hydrophilicity provides improved final appearance by providing "sheeting" of the water from the surface and/or spreading of the water on the surface, and this effect is particularly seen when the surface is wiped with the premoistened disposable substrate, during which process the silicone component is preferentially deposited onto the treated surface and the excess water present in the composition is to be removed during the wiping process. A beneficial effect is also achieved when treated surfaces are rewetted and even when subsequently dried after the rewetting with a subsequent treatment with the inventive compositions. Polymer substantivity is beneficial as it prolongs the sheeting and cleaning benefits. Another desirable feature of the cleaning polymers is lack of visible residue upon drying.

In general, the inventive compositions may employ water-soluble or water dispersible cleaning polymers. The inventive compositions may employ nonionic (neutral and/or non-ionizable), anionic and/or cationic polymers, and their mixtures. Suitable anionic polymers include those with ionizable groups that are at least partially anionic in solution, that is carrying a negative charge in solution, or which can be at least partially or fully neutralized to be at least partially or fully anionic in solution. Suitable cationic polymers include polymers that are ionizable (i.e. capable of being protonated) and those with permanent cationic groups, that is carrying a permanent positive charge, in solution. The inventive compositions may employ hydrophilic polymers, hydrophobic polymers or polymers exhibiting both properties owing to the presence of hydrophilic and hydrophobic monomer moieties. Suitable hydrophilic polymers are those that are preferably attracted to surfaces and are absorbed thereto without covalent bonds. Examples of suitable polymers include the polymers and co-polymers of N,N-dialkyl acrylamide, acrylamide, and certain monomers containing substituted and/or unsubstituted quaternary ammonium groups and/or amphoteric groups that favor substantivity to surfaces, along with co-monomers that favor adsorption of water, such as, for example, acrylic acid and other acrylate salts, sulfonates, betaines, and ethylene oxides. Water soluble or water dispersible cationic polymers may be suitable for their charge dissipative effect, antistatic, surface lubricating and potential softening benefits.

The cleaning polymers adsorbs irreversibly on the disposable substrate and helps clean or trap the dirt on it. This prevents the dirt from being smeared around or redeposited on the leather surface that is being cleaned.

The cleaning polymers in general and their method of manufacture are known in the literature. For example, a detailed description of cationic polymers can be found in an article by M. Fred Hoover that was published in the Journal of Macromolecular Science-Chemistry, A4(6), pp 1327-1417, October, 1970. The entire disclosure of the Hoover article is incorporated herein by reference. Other suitable cationic polymers are those used as retention aids in the manufacture of paper. They are described in "Pulp and Paper, Chemistry and Chemical Technology Volume III edited by James Casey (1981). The molecular weight of these polymers is in the range of 2000-10 million.

The cleaning polymers of this invention will be better understood when read in light of the Hoover article and the Casey book, the present disclosure and the Instant Examples herein.

Suitable cleaning polymers are listed below.

Polyacrylic acid type polymers and its derivatives such as ACUSOL type or GLASCOL E-11.

Sodium acrylate polymers and its copolymer derivatives such as RHEOVIS ADP.

Polyacrylamide polymers, both linear and crosslinked, having molecular weights ranging from about one million to about 25 million Daltons such as Magnafloc APC.

Polyethyleneimine and its derivatives. These are commercially available under the trade name LUPASOL ex. BASF AG of Ludwigschaefen, Germany.

Polyamidoamine-epichlorohydrin (PAE) Resins which are condensation products of polyalkylenepolyamine with polycarboxyic acid. The most common PAE resins are the condensation products of diethylenetriamine with adipic acid followed by a subsequent reaction with epichlorohydrin. They are available from Hercules Inc. of Wilmington, Del. under the trade name KYMENE or from BASF A.G. under the trade name LURESIN.

These polymers are described in Wet Strength Resins and Their Applications edited by L. L. Chan, TAPPI Press (1994).

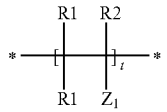

wherein t is repeating unit, R1, R2, and Z1 are defined herein below. The linear polymer units are typically formed from linearly polymerizing monomers. Linearly polymerizing monomers are defined herein as monomers which under standard polymerizing conditions result in a linear polymer chain or alternatively which linearly propagate polymerization. The linearly polymerizing monomers of the present invention have the formula:

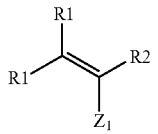

however, those of skill in the art recognize that many useful linear monomer units are introduced indirectly, inter alia, vinyl amine units, vinyl alcohol units, and not by way of linearly polymerizing monomers. For example, vinyl acetate monomers once incorporated into the backbone are hydrolyzed to form vinyl alcohol units. For the purposes of the present invention, linear polymer units may be directly introduced, i.e. via linearly polymerizing units, or indirectly, i.e. via a precursor as in the case of vinyl alcohol cited herein above.

Each R1 is independently hydrogen, C1-C4 alkyl, substituted or unsubstituted phenyl, substituted or unsubstituted benzyl, carbocyclic, heterocyclic, and mixtures thereof. Preferably R1 is hydrogen, C1-C4 alkyl, phenyl, and mixtures thereof, more preferably hydrogen and methyl.

Each R2 is independently hydrogen, halogen, C1-C4 alkyl, C1-C4 alkoxy, substituted or unsubstituted phenyl, substituted or unsubstituted benzyl, carbocyclic, heterocyclic, and mixtures thereof. Preferred R2 is hydrogen, C1-C4 alkyl, and mixtures thereof.

Each Z1 is independently hydrogen; hydroxyl; halogen; —(CH2)mR, wherein R is hydrogen, hydroxyl, halogen, nitrilo, —OR3, —O(CH2)nN(R3)2, —O(CH2)nN+(R3)3X−, —OCO(CH2)nN(R3)2, —OCO(CH2)nN+(R3)3X−, —C(O)NH—(CH2)nN(R3)2, —C(O)NH(CH2)nN+(R3)3X−, —(CH2)nN(R3)2, —(CH2)nN+(R3)3X−, a non-aromatic nitrogen heterocycle comprising a quaternary ammonium ion, a non-aromatic nitrogen heterocycle comprising an N-oxide moiety, an aromatic nitrogen containing heterocyclic wherein one or more or the nitrogen atoms is quaternized; an aromatic nitrogen containing heterocycle wherein at least one nitrogen is an N-oxide; —NHCHO (formamide), or mixtures thereof; wherein each R3 is independently hydrogen, C1-C8 alkyl, C2-C8 hydroxyalkyl, and mixtures thereof; X is a water soluble anion; the index n is from 1 to 6; carbocyclic, heterocyclic, or mixtures thereof; —(CH2)mCOR' wherein R' is —OR3, —O(CH2)nN(R3)2, —O(CH2)nN+(R3)3X−, —NR3(CH2)nN(R3)2, —NR3(CH2)nN+(R3)3X−, —(CH2)nN(R3)2, —(CH2)nN+(R3)3X−, or mixtures thereof, wherein R3, X, and n are the same as defined herein above. A preferred Z1 is —O(CH2)nN+(R3)3X−, wherein the index n is 2 to 4. The index m is from 0 to 6, preferably 0 to 2, more preferably 0.

Non-limiting examples of addition polymerizing monomers comprising a heterocyclic Z1 unit includes 1-vinyl-2-pyrrolidinone, 1-vinylimidazole, 2-vinyl-1,3-dioxolane, 4-vinyl-1-cyclohexenel, 2-epoxide, and 2-vinylpyridine.

The cleaning polymers and co-polymers of the present invention comprise Z1 units which have a cationic charge or which result in a unit which forms a cationic charge in situ. When the co-polymers of the present invention comprise more than one Z1 unit, for example, Z1, Z2, Z3, . . . Zn units, at least about 1% of the monomers which comprise the co-polymers will comprise a cationic unit. Preferred cationic units include —O(CH2)nN+(R3)3X− and —(CH2)nN+(R3)3X−. When the co-polymers of the present invention are formed from two monomers, Z1 and Z2, the ratio of Z1 to Z2 is preferably from about 9:1 to about 1:9.

A non-limiting example of a Z1 unit which can be made to form a cationic charge in situ is the —NHCHO unit, formamide. The formulator can prepare a polymer or co-polymer comprising formamide units some of which are subsequently hydrolyzed to form vinyl amine equivalents. For example, the formulator may prepare a co-polymer having the general formula:

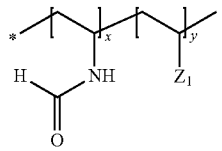

which comprises a formamide unit and then subsequently treat the co-polymer such that some of the formamide units are hydrolyzed to form a co-polymer comprising vinyl amine units, said polymer having the formula:

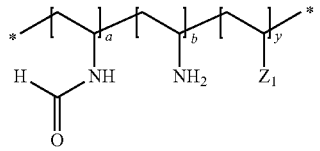

wherein Z1 may be a cationic unit comprising or non-cationic unit comprising moiety and a+b=x.

Another class of preferred linearly polymerizable monomers comprise cationically charged heteroaromatic Z1 units having the formula:

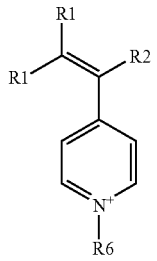

an non-limiting example of which is 4-vinyl(N-alkyl)pyridine wherein R1 and R2 are each hydrogen and R6 is methyl.

Another class of preferred linearly polymerizable monomers which comprises a heterocyclic ring includes Z units comprising an N-oxide, for example, the N-oxide having the formula:

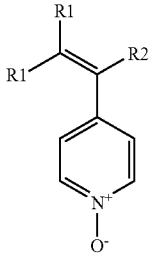

a non-limiting example of which is 4-vinyl pyridine N-oxide.

N-alkyl vinylpyridine monomers and N-oxide vinylpyridine monomers can be suitably combined with other non aromatic monomers, inter alia, vinyl amine. However, preferred polymers of the present invention include co-polymers derived from a combination of quaternized, N-oxide, and nitrogen containing heteroaromatic monomers, non-limiting examples of which includes a copolymer of N-methyl vinyl pyridine and vinyl pyridine in a ratio of 4:1; a copolymer of N-methyl vinyl pyridine and vinyl pyridine in a ratio of 4:6; a co-polymer of poly(N-methyl vinyl pyridine) and vinyl pyridine N-oxide in a ratio of polymer to monomer of 4:1; poly (N-methyl vinyl pyridine) and vinyl pyridine N-oxide in a ratio of polymer to monomer of 4:6; and mixtures thereof.

As described herein above, some preferred polymer residues may be formed by treatment of the resulting polymer. For example, vinyl amine residues are preferably introduced via formamide monomers which are subsequently hydrolyzed to the free amino unit. Also vinyl alcohol units are obtained by hydrolysis of residues formed form vinyl acetate monomers. Likewise, acrylic acid residues may be esterified after polymerization, for example, units having the formula:

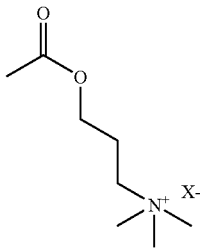

may be more conveniently formed after the backbone has been formed by polymerization with acrylic acid or acrylic acid precursor monomers.

The cleaning polymers or co-polymers of the present invention can comprise one or more cyclic polymer units which are derived from cyclically polymerizing monomers. Cyclically polymerizing monomers are defined herein as monomers which under standard polymerizing conditions result in a cyclic polymer residue as well as serving to linearly propagate polymerization. Preferred cyclically polymerizing monomers of the present invention have the formula:

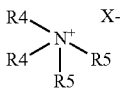

wherein each R4 is independently an olefin comprising unit which is capable of propagating polymerization in addition to forming a cyclic residue with an adjacent R4 unit; R5 is C1-C12 linear or branched alkyl, benzyl, substituted benzyl, and mixtures thereof; X is a water soluble anion.

Non-limiting examples of R4 units include allyl and alkyl substituted allyl units. Preferably the resulting cyclic residue is a six-member ring comprising a quaternary nitrogen atom.

R5 is preferably C1-C4 alkyl, preferably methyl.

An example of a cyclically polymerizing monomer is dimethyl diallyl ammonium having the formula:

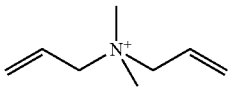

which results in a polymer or co-polymer having units with the formula:

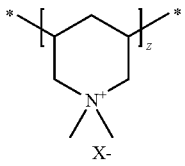

wherein preferably the index z is from about 10 to about 50,000.

The cleaning polymers or co-polymers of the present invention retain a net cationic charge, whether the charged is developed in situ, or whether the polymer or co-polymer itself has a formal positive charge. Preferably the polymer or co-polymer has at least 10%, more preferably at least about 25%, more preferably at least about 35%, most preferably at least about 50% of the residues comprise a cationic charge.

The cleaning polymers or co-polymers of the present invention can comprise mixtures of linearly and cyclically polymerizing monomers, for example the poly(dimethyldiallyl-ammonium chloride/acrylamide) co-polymer having the formula:

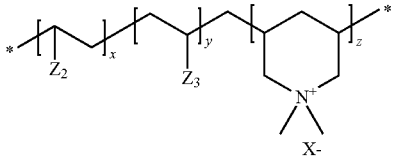

wherein Z2, Z3, x, y, and z are the same as defined herein above and X is chloride ion.

One embodiment of this invention is the composition comprising a polymer based on dimethyldiallylammonium chloride and a copolymer which is based upon acrylamide with a co-monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quaternized derivatives and mixtures thereof.

Non-limiting examples of polymers suitable for use with the present invention include cleaning copolymers comprising: i) a first monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quaternized derivatives, vinylamine or its derivatives, allylamine or its derivatives and mixtures thereof; and ii) a second monomer selected from the group consisting of acrylic acid, methacrylic acid, C1-C6 alkylmethacrylate, C1-C6 alkyl acrylate, C1-C8 hydroxyalkylacrylate, C1-C8 hydroxyalkylmethacrylate, acrylamide, C1-C16 alkyl acrylamide, C1-C16 dialkylacrylamide, 2-acrylamido-2-methylpropane sulfonic acid or its alkali salt, methacrylamide, C1-C16 alkylmethacrylamide, C1-C16 dialkylmethacrylamide, vinyl formamide, vinylacetamide, vinyl alcohol, C1-C8 vinylalkylether, vinyl pyridine, itaconic acid, vinyl acetate, vinyl propionate, vinyl butyrate and mixtures thereof;

Cationic polysaccharides preferably cationic hydroxyethyl cellulose, cationic guar gum and cationic starches. Examples of cationic hydroxyethyl cellulose is UCARE Polymer JR 25M, Polymer JR 400, Polymer LK 400 and Polymer LR 400 all available from Dow Chemicals Co and CELQUAT H200 and CELQUAT L-200 available from National Starch and Chemical Company or Bridgewater, N.J.

Examples of cationic guar gums are JAGUAR C13 and JAGUAR EXCEL available from Rhodia Examples of cationic starches are described by D. B. Solarek in Modified Starches, Properties and Uses published by CRC Press (1986). Cationic starches are commercially available from National Starch and Chemical Company under the Trade Name Cato.

The cleaning polymers of component b) iv) of the cleaning composition herein may comprise from about 0.001% to 15% based on weight of the cleaning composition. Preferably such cleaning compositions comprise from about 0.01% to 10%, based on weight of the cleaning composition, of the cleaning polymers. Preferably such cleaning compositions comprise from about 0.01% to 8%, based on weight of the cleaning composition, of the cleaning polymers. More preferably such cleaning compositions comprise from about 0.01% to 5%, based on the weight of the cleaning composition, of the cleaning polymers.

The UV absorbers of component b) v) of the cleaning composition are selected from the group consisting of 2H-benzotriazoles, s-triazines, benzophenones, alpha-cyanoacrylates, oxanilides, benzoxazinones, benzoates, alpha-alkyl cinnamates and mixtures thereof.

The UV absorbers are, for example, selected from the group consisting of 2,4,6-tris(2-hydroxy-4-octyloxyphenyl)-1,3,5-triazine;

2-(2,4-dihydroxyphenyl)-4,6-bis(2,4-dimethylphenyl)-1,3,5-triazine;

2,4-bis(2-hydroxy-4-propyloxyphenyl)-6-(2,4-dimethylphenyl)-1,3,5-triazine;

2-(2-hydroxy-4-octyloxyphenyl)-4,6-bis(4-methylphenyl)-1,3,5-triazine;

2-(2-hydroxy-4-dodecyloxyphenyl)-4,6-bis(2,4-dimethylphenyl)-1,3,5-triazine;

2-[2-hydroxy-4-(2-hydroxy-3-butyloxypropyloxy)phenyl]-4,6-bis(2,4-dimethylphenyl)-1,3,5-triazine;

2-[2-hydroxy-4-(2-hydroxy-3-octyloxypropyloxy)phenyl]-4,6-bis(2,4-dimethylphenyl)-1,3,5-triazine;

2-[2-hydroxy-4-(2-hydroxy-3-tridecyloxy-propyloxy)phenyl]-4,6-bis(2,4-dimethylphenyl)-1,3,5-triazine;

5-chloro-2-(2-hydroxy-3,5-di-tert-butylphenyl)-2H-benzotriazole;

2-(2-hydroxy-3-dodecyl-5-methylphenyl)-2H-benzotriazole;

5-chloro-2-(2-hydroxy-3-tert-butyl-5-methylphenyl)-2H-benzotriazole;

bis-(3-(2H-benzotriazol-2-yl)-2-hydroxy-5-tert-octyl)methane;
2-(2-hydroxy-3,5-di-tert-butylphenyl)-2H-benzotriazole;
2-(2-hydroxy-3,5-di-tert-amylphenyl)-2H-benzotriazole;
2-(2-hydroxy-3,5-di-α-cumylphenyl)-2H-benzotriazole;
2-(2-hydroxy-3-α-cumyl-5-tert-octylphenyl)-2H-benzotriazole;
2-(2-hydroxy-5-tert-octylphenyl)-2H-benzotriazole;
3-(2H-benzotriazol-2-yl)-4-hydroxy-5-(1-methylpropyl)-benzenesulfonic acid monosodium salt;
3-tert-butyl-4-hydroxy-5-(2H-benzotriazol-2-yl)-hydrocinnamic acid and sodium salt;
12-hydroxy-3,6,9-trioxadodecyl 3-tert-butyl-4-hydroxy-5-(2H-benzotriazol-2-yl)-hydrocinnamate;
octyl 3-tert-butyl-4-hydroxy-5-(2H-benzotriazol-2-yl)-hydrocinnamate;
4,6-bis(2,4-dimethylphenyl)-2-(4-(3-dodecyloxy*-2-hydroxypropoxy)-2-hydroxyphenyl)-s-triazine (* is mixture of $C_{12-14}$oxy isomers);
4,6-bis(2,4-dimethylphenyl)-2-(4-octyloxy-2-hydroxyphenyl)-s-triazine;
2,4-dihydroxybenzophenone;
2,2'-dihydroxy-4,4'-dimethoxy-5,5'-disulfobenzophenone, disodium salt;
2-hydroxy-4-octyloxybenzophenone;
2-hydroxy-4-dodecyloxybenzophenone;
2,4-dihydroxybenzophenone;
2,2',4,4'-tetrahydroxybenzophenone;
4-aminobenzoic acid;
2,3-dihydroxypropyl-4-aminobenzoic acid;
3-(4-imidazolyl)acrylic acid;
2-phenyl-5-benzimidazole sulfonic acid;
N,N,N-trimethyl-α-(2-oxo-3-bornylidene)-p-toluidinium methyl sulfate;
5-benzoyl-4-hydroxy-2-methoxybenzenesulfonic acid, sodium salt;
3-(4-benzoyl-3-hydroxyphenoxy)-2-hydroxy-N,N,N-trimethyl-1-propanaminium chloride;
3-[4-(2H-benzotriazol-2-yl)-3-hydroxyphenoxy]-2-hydroxy-N,N,N-trimethyl-1-propanaminium, chloride;
2-(2-hydroxy-5-methylphenyl)-2H-benzotriazole;
2,2'-dihydroxy-4,4'-dimethoxybenzophenone (Uvinul® 3049); and mixtures thereof.

For instance, suitable UV absorbers are selected from the group consisting of 3-(2H-benzotriazol-2-yl)-4-hydroxy-5-(1-methylpropyl)-benzenesulfonic acid monosodium salt;
3-tert-butyl-4-hydroxy-5-(2H-benzotriazol-2-yl)-hydrocinnamic acid and sodium salt;
2-(2-hydroxy-3,5-di-tert-butylphenyl)-2H-benzotriazole;
2-(2-hydroxy-3,5-di-tert-amylphenyl)-2H-benzotriazole;
4,6-bis(2,4-dimethylphenyl)-2-(4-(3-dodecyloxy*-2-hydroxypropoxy)-2-hydroxyphenyl)-s-triazine (* is mixture of $C_{12-14}$oxy isomers);
12-hydroxy-3,6,9-trioxadodecyl-3-tert-butyl-4-hydroxy-5-(2H-benzotriazol-2-yl)-hydrocinnamate;
2,4-dihydroxybenzophenone;
2,2'-dihydroxy-4,4'-dimethoxy-5,5'-disulfobenzophenone, disodium salt;
2,2',4,4'-tetrahydroxybenzophenone;
3-(4-benzoyl-3-hydroxyphenoxy)-2-hydroxy-N,N,N-trimethyl-1-propanaminium chloride;
3-[4-(2H-benzotriazol-2-yl)-3-hydroxyphenoxy]-2-hydroxy-N,N,N-trimethyl-1-propanaminium, chloride;
5-benzoyl-4-hydroxy-2-methoxy-benzenesulfonic acid, sodium salt;
2-(2-hydroxy-3-dodecyl-5-methylphenyl)-2H-benzotriazole;
2-(2-hydroxy-3-α-cumyl-5-tert-octylphenyl)-2H-benzotriazole; and mixtures thereof.

Component b) v) of the cleaning composition may additionally contain at least one compound selected from the group consisting of antioxidants, tocopherol, tocopherol acetate, hindered amine light stabilizers, complex formers and optical brighteners. The additional compounds of present component b) v) are for example those disclosed in co-pending U.S. application Ser. No. 09/830,788, filed May 1, 2001 and Ser. No. 09/830,787, filed May 1, 2001. The disclosures of these co-pending applications are hereby incorporated by reference. These applications are published as WO 00/25730 and WO 00/25731.

The UV absorbers of component b) v) of the cleaning composition herein may comprise from about 0.001% to 15% based on weight of the cleaning composition. Preferably such cleaning compositions comprise from about 0.01% to 10%, based on weight of the cleaning composition, of the UV absorbers. More preferably such cleaning compositions comprise from about 0.1% to 5%, based on the weight of the cleaning composition, of the UV absorbers. Even more preferably such cleaning compositions comprise from about 0.1% to 2%, based on the weight of the cleaning composition, of the UV absorbers.

The wetting agent of component b) vi) of the cleaning composition improves the wetting of hydrophobic surfaces, promote flow, decrease beading, ridges or thin spots during application of the cleaning composition to the leather surface, and/or aids in the prevention of coagulation of solids or gellation of the cleaning composition. Also, wetting most generally is the process of displacing from a surface (solid or liquid) one fluid, such as air, with another, such as water. Additionally, the wetting agent improves the deposition of UV actives on the leather surface or simulated leather, for example vinyl, and improves gloss. Effective wetting agents according to the instant invention are, for example, anionic surfactants, sodium lauryl sulfate, sodium octane sulfonate, sulfonic acids, low HLB ethoxylated alcohols, propoxylated alcohols, propoxylated/ethoxylated alcohol, ethylene oxide (EO)/propylene oxide (PO) block co-polymers, alkylpolyglucosides, amphoteric surfactants, and cationic surfactants. Additional examples of suitable wetting agents include glycol ethers, for example, polypropylene glycol and polyethylene glycol, tributoxyethylphosphate and alcohol ethoxylates. An example of an alcohol ethoxylate is BEROL 260 is C9-11 alcohol ethoxylate with 4 EO (ethylene oxide) units, which is available from Akzo Nobel. Additional effective wetting agents are listed in Handbook of Industrial Surfactants, Third Edition, Volume 2, pages 1848-1878, compiled by Michael and Irene Ash, published by Synapse Information Resources, Inc. (2000), incorporated herein by reference.

The wetting agent is present from about 0.001% to about 20% by weight of the cleaning composition. Another embodiment of the instant invention is the wetting agent being present from about 0.1% to about 15% by weight of the cleaning composition. Another embodiment of the instant invention is the wetting agent being present from about 0.1% to about 10% by weight of the cleaning composition. Another embodiment of the instant invention is the wetting agent being present from about 1% to about 10% by weight of the cleaning composition.

The amount of water comprised in the cleaning composition will depend on the amount of the other components that are present. The total of all the components in the cleaning formulation including water is 100% based on weight of the cleaning composition. The source of the water can be either tap, distilled, or deionized.

The inventive cleaning composition may contain one or more cleaning agents and/or cleaning aid adjuvants. Suitable cleaning agents and cleaning aid adjuvants, for example, include, but are not limited to surfactants, solvents, bleaches, chelators, sequestrants, builders, polymers, enzymes, oxidants, surface modification agents, soil repellants, alkalis, alkalinity and acidity agents, pH adjustors, pH buffers, wetting agents, spreading agents, leveling agents and mixtures thereof. Enzymes, when used, include but are not limited to amylases, proteases, pectinases, cellulases, lipases, peroxidases and hydrolases, and their mixtures. Bleaching agents, when used, include, but are not limited to, peracids, hypohalite sources, hydrogen peroxide, and/or sources of hydrogen peroxide, or active oxygen and/or active halogens and/or active halogen releasing agents.

These optional one or more cleaning agents and/or cleaning aid adjuvants may be employed in embodiments of the inventive composition to provide further cleaning and protective benefit or functionality to the inventive composition.

In suitable embodiments, the cleaning agent and/or cleaning aid adjuvant comprises 0.0001% by weight to about 10% by weight, or 0.001% by weight to about 5% by weight, or alternatively 0.01% by weight to about 1% by weight of the inventive composition.

The inventive cleaning compositions optionally contain one or more of the following adjuncts: lubricants, wetting agents, spreading agents, odor control agents, perfumes, fragrances and fragrance release agents, UV scatterers, infra-red (IR) absorbers, IR scatterers, excited state quenchers (ESQ), and their mixtures. Other adjuncts include, but are not limited to, acids, electrolytes, dyes and/or colorants and/or pigments, solubilizing materials, stabilizers, thickeners, defoamers, hydrotropes, cloud point modifiers, preservatives, and other polymers and their mixtures. The solubilizing materials, when used, include, but are not limited to, hydrotropes (e.g. water soluble salts of low molecular weight organic acids such as the sodium and/or potassium salts of toluene, cumene, and xylene sulfonic acid). Defoamers, when used, include, but are not limited to, silicones, aminosilicones, silicone blends, and/or silicone/hydrocarbon blends.

In suitable embodiments, the additional adjunct comprises 0.0001% by weight to about 20% by weight, or 0.001% by weight to about 10% by weight, or alternatively 0.01% by weight to about 5% by weight of the inventive composition.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. DANTOGARD and/or GLYDANT) and/or short chain alcohols (e.g. ethanol and/or IPA). The mildewstat or bacteriostat includes, but is not limited to, mildewstats (including non-isothiazolinones compounds) including PROXEL GXL and VANTOCIL IB, from Avecia Corporation, KATHON GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, and Neolone M-10, all available from Rohm and Haas Company; BRONOPOL, a 2-bromo-2-nitropropane 1, 3 diol, from Boots Company Ltd., PROXEL CRL, a propyl-p-hydroxybenzoate, from ICI PLC; NIPASOL M, an o-phenyl-phenol, sodium salt, from Nipa Laboratories Ltd., DOWICIDE A, a 1,2-Benzoisothiazolin-3-one, DOWACIL 75, and BIOBAN, all from Dow Chemical Co., and IRGASAN DP 200, a 2,4,4'-trichloro-2-hydroxydiphenyleth-er, from Ciba Specialty Chemicals, and SURCIDE P from Surety Laboratories.

In suitable embodiments, the preservative comprises 0.0001% by weight to about 1% by weight, or 0.001% by weight to about 0.5% by weight, or alternatively 0.01% by weight to about 0.5% by weight of the inventive composition.

Antimicrobial agents include quaternary ammonium compounds and phenolics. Non-limiting examples of these quaternary compounds include benzalkonium chlorides and/or substituted benzalkonium chlorides, di(C6-C14)alkyl di short chain (C1-4 alkyl and/or hydroxyalkl) quaternary ammonium salts, N-(3-chloroallyl)hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylbenzylammonium chlorides, and mixtures thereof, wherein the alkyl radicals may be C1 to C24. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class.

In suitable embodiments, the antimicrobial comprises 0.0001% by weight to about 10% by weight, or 0.001% by weight to about 5% by weight, or alternatively 0.01% by weight to about 2.5% by weight of the inventive composition.

The inventive composition may include an alkalizing agent, selected from the class of materials commonly known as pH adjusters, alkalis (bases), alkalinity agents, builders, buffers, and their combinations. The alkalizing agents generally serve to adjust and/or control the pH of the composition and may also serve to increase the effectiveness of the optional cleaning adjuncts. The alkalizing agent may be employed to neutralize or partially neutralize polymers employed in the present invention that have ionizable anionic functionalities. The alkalizing agent may be selected from known pH adjustors, bases, alkali materials, builders and buffers, including but not limited to those described herein. The builder and/or buffer can also function as a water softener and/or a sequestering agent in the inventive composition. A variety of builders and/or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, crown ethers, cyclodextrins and starch derivatives.

Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Exemplary buffering agents for compositions of this invention are nitrogen-containing materials. Some examples are amino acids such as lysine or lower alcohol amines like mono-, di-, and tri-ethanolamine. Other exemplary nitrogen-containing buffering agents are tri(hydroxymethyl)amino methane (TRIS), 2-amino-2-ethyl-1,3-propanedi-ol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine(bicine) and N-tris(hydroxymethyl)methyl glycine(tricine), morpholine and morpholine derivatives. Other suitable buffers include ammonium carbamate, citric acid, acetic acid. Mixtures of any of the above are also acceptable.

Useful inorganic buffers/alkalinity sources include ammonia, the alkali metal carbonates and alkali metal phosphates, e.g., sodium carbonate, sodium polyphosphate. Additional buffers are disclosed in WO 95/07971, which is incorporated herein by reference. Other suitable pH adjusting agents include sodium or potassium hydroxide. Alternatively, in an embodiment of the current invention, an alkalizing agent is selected that exhibits or combines one or more of the desired properties of the class of materials known in the art as pH adjusters, alkalis, base, alkalinity agents, builders and buffers. For example, in one embodiment of the invention, a builder that serves as an alkalizer or pH adjusting agent effective at controlling the composition pH as well as providing builder functionality to the inventive compositions during use is selected. In another embodiment of the invention, a buffer is employed that serves to at least partially neutralize a polymer during the preparation stage of the compositions, and further serves to control the pH of the inventive composition over long storage times.

In suitable embodiments, the alkalizer agent, which may be selected from any one or more of a pH adjuster, an alkali, a base, an alkalinity agent, a builder, a buffer or any combination thereof, comprises 0.0001% by weight to about 10% by weight, or 0.001% by weight to about 5% by weight, or alternatively 0.01% by weight to about 1% by weight of the inventive composition.

In suitable embodiments of the invention, a polymeric material that further changes the rheological characteristics of the inventive compositions is incorporated, provided that such addition does not effectively change either the Critical Strain Value and/or the Elastic Modulus Value of the composition to values outside of the respective selected ranges of Critical Stain Value and/or Elastic Modulus Value as defined herein. For some combinations of compositions and substrates a polymeric thickener may be suitable. Polymeric thickeners, when used, include, but are not limited to, polyacrylic acid and copolymers, polysaccharide polymers, which include substituted cellulose materials like carboxymethylcellulose, ethyl cellulose, hydroxyethylcellulose, hydroxypropylcellulose, hydroxymethylcellulose, succinoglycan and naturally occurring polysaccharide polymers like pectin, xanthan gum, guar gum, locust bean gum, tragacanth gum or derivatives thereof, and naturally occurring proteins and peptides like peptin, peptone, and the like, as well as polysaccharide and peptide polymers, such as peptidoglycans and the like. Inorganic thickeners, such as clays, silicas, zeolites, finely divided metal oxides, finely divided inorganic minerals and nanoparticulate materials, and their mixtures, may also be suitably employed.

In suitable embodiments, the thickener comprises 0.01% by weight to about 10% by weight, or 0.01% by weight to about 5% by weight, or alternatively 0.1% by weight to about 1% by weight of the inventive composition.

As used herein the term "fragrance oil" relates to the mixture of perfume raw materials that are used to impart an overall pleasant odor profile to a composition. As used herein the term "perfume raw material" relates to any chemical compound which is odiferous when in an un-entrapped state, for example in the case of pro-perfumes, the perfume component is considered, for the purposes of this invention, to be a perfume raw material, and the pro-chemistry anchor is considered to be the entrapment material. In addition "perfume raw materials" are defined by materials with a ClogP value preferably greater than about 0.1, more preferably greater than about 0.5, even more preferably greater than about 1.0. As used herein the term "ClogP" means the logarithm to base 10 of the octanol/water partition coefficient. This can be readily calculated from a program called "CLOGP" which is available from Daylight Chemical Information Systems Inc., Irvine Calif., U.S.A. Octanol/water partition coefficients are described in more detail in U.S. Pat. No. 5,578,563, which is hereby incorporated by reference.

The individual perfume raw materials which comprise a known natural oil can be found by reference to journals commonly used by those skilled in the art such as "Perfume and Flavourist" or "Journal of Essential Oil Research". In addition, some perfume raw materials are supplied by the fragrance houses as mixtures in the form of proprietary specialty accords. In order that fragrance oils can be developed with the appropriate character for the present invention the perfume raw materials have been classified based upon two key physical characteristics:

(i) boiling point (BP) measured at 1 atmosphere pressure. The boiling point of many fragrance materials are given in Perfume and Flavor Chemicals (Aroma Chemicals), Steffen Arctander (1969). Perfume raw materials for use in the present invention are divided into volatile raw materials (which have a boiling point of less than, or equal to, about 250C) and residual raw materials (which have a boiling point of greater than about 250C, preferably greater than about 275C). All perfume raw materials will preferably have boiling points (BP) of about 500C or lower.

(ii) odor detection threshold which is defined as the lowest vapor concentration of that material which can be olfactorily detected. The odor detection threshold and some odor detection threshold values are discussed in e.g., "Standardized Human Olfactory Thresholds", M. Devos et al, IRL Press at Oxford University Press, 1990, and "Compilation of Odor and Taste Threshold Values Data", F. A. Fazzalar, editor ASTM Data Series DS 48A, American Society for Testing and Materials, 1978, both of said publications being incorporated by reference. Perfume raw materials for use in the present invention can be classified as those with a low odor detection threshold of less than 50 parts per billion, preferably less than 10 parts per billion and those with a high odor detection threshold which are detectable at greater than 50 parts per billion (values as determined from the references above).

Since, in general, perfume raw materials refer to a single individual compound, their physical properties (such as ClogP, boiling point, odor detection threshold) can be found by referencing the citations above. In the case that the perfume raw material is a natural oil, which comprises a mixture of several compounds, the physical properties of the complete oil should be taken as the weighted average of the individual components. In the case that the perfume raw material is a proprietary specialty accord the physical properties should be obtained from the supplier.

In general, a broad range of suitable perfume raw materials can be found in U.S. Pat. Nos. 4,145,184; 4,209,417; 4,515,705; and 4,152,272, all of which are hereby incorporated by reference. Non-limiting examples of perfume raw materials which are useful for blending to formulate fragrance oils for the present invention are given below. Any perfume raw materials, natural oils or proprietary specialty accords known to a person skilled in the art can be used within the present invention.

Volatile perfume raw materials useful in the present invention are selected from, but are not limited to, aldehydes with a relative molecular mass of less than or equal to about 200, esters with a relative molecular mass of less than or equal to about 225, terpenes with a relative molecular mass of less than or equal to about 200, alcohols with a relative molecular mass of less than or equal to about 200 ketones with a relative molecular mass of less than or equal to about 200, nitriles, pyrazines, and mixtures thereof.

Examples of volatile perfume raw materials having a boiling point of less than, or equal to, 250C, with a low odor detection are selected from, but are not limited to, anethol, methyl heptane carbonate, ethyl aceto acetate, para cymene, nerol, decyl aldehyde, para cresol, methyl phenyl carbinyl acetate, ionone alpha, ionone beta, undecylenic aldehyde, undecyl aldehyde, 2,6-nonadienal, nonyl aldehyde, and octyl aldehyde. Further examples of volatile perfume raw materials having a boiling point of less than, or equal to, 250C, which are generally known to have a low odor detection threshold include, but are not limited to, phenyl acetaldehyde, anisic aldehyde, benzyl acetone, ethyl-2-methyl butyrate, damascenone, damascone alpha, damascone beta, floracetate, frutene, fructone, herbavert, iso cyclo citral, methyl isobutenyl tetrahydro pyran, iso propyl quinoline, 2,6-nonadien-1-ol, 2-methoxy-3-(2-methylpropyl)-pyrazine, methyl octine carbonate, tridecene-2-nitrile, allyl amyl glycolate, cyclogalbanate, cyclal C, melonal, gamma nonalactone, and cis 1,3-oxathiane-2-methyl-4-propyl.

Other volatile perfume raw materials having a boiling point of less than, or equal to, 250C, which are useful in the present invention, which have a high odor detection threshold, are selected from, but are not limited to, benzaldehyde, benzyl acetate, camphor, carvone, borneol, bornyl acetate, decyl alcohol, eucalyptol, linalool, hexyl acetate, iso-amyl acetate, thymol, carvacrol, limonene, menthol, iso-amyl alcohol, phenyl ethyl alcohol, alpha pinene, alpha terpineol, citronellol, alpha thujone, benzyl alcohol, beta gamma hexenol, dimethyl benzyl carbinol, phenyl ethyl dimethyl carbinol, adoxal, allyl cyclohexane propionate, beta pinene, citral, citronellyl acetate, citronellal nitrile, dihydro myrcenol, geraniol, geranyl acetate, geranyl nitrile, hydroquinone dimethyl ether, hydroxycitronellal, linalyl acetate, phenyl acetaldehyde dimethyl acetal, phenyl propyl alcohol, prenyl acetate, triplal, tetrahydrolinalool, verdox, and cis-3-hexenyl acetate.

Examples of residual "middle and base note" perfume raw materials having a boiling point of greater than 250C, which have a low odor detection threshold are selected from, but are not limited to, ethyl methyl phenyl glycidate, ethyl vanillin, heliotropin, indol, methyl anthranilate, vanillin, and amyl salicylate, coumarin. Further examples of residual perfume raw materials having a boiling point of greater than 250C which are generally known to have a low odor detection threshold include, but are not limited to, ambrox, bacdanol, benzyl salicylate, butyl anthranilate, cetalox, ebanol, cis-3-hexenyl salicylate, lilial, gamma undecalactone, gamma dodecalactone, gamma decalactone, calone, cymal, dihydro iso jasmonate, iso eugenol, lyral, methyl beta naphthyl ketone, beta naphthol methyl ether, para hydroxylphenyl butanone, 8-cyclohexadecen-1-one, oxocyclohexadecen-2-one/-habanolide, florhydral, and intreleven aldehyde.

Other residual "middle and base note" perfume raw materials having a boiling point of greater than 250C which are useful in the present invention, but which have a high odor detection threshold, are selected from, but are not limited to, eugenol, amyl cinnamic aldehyde, hexyl cinnamic aldehyde, hexyl salicylate, methyl dihydro jasmonate, sandalore, veloutone, undecavertol, exaltolide/cyclopentadecanolide, zingerone, methyl cedrylone, sandela, dimethyl benzyl carbinyl butyrate, dimethyl benzyl carbinyl isobutyrate, triethyl citrate, cashmeran, phenoxy ethyl isobutyrate, iso eugenol acetate, helional, iso E super, ionone gamma methyl, pentalide, galaxolide, and phenoxy ethyl propionate.

In suitable embodiments, the fragrance and/or perfume comprises 0.0001% by weight to about 10% by weight, or 0.001% by weight to about 5% by weight, or alternatively 0.01% by weight to about 1% by weight of the inventive composition.

The following examples describe certain embodiments of this invention, but the invention is not limited thereto. It should be understood that numerous changes to the disclosed embodiments could be made in accordance with the disclosure herein without departing from the spirit or scope of the invention. These examples are therefore not meant to limit the scope of the invention. Rather, the scope of the invention is to be determined only by the appended claims and their equivalents. In these examples, all parts given are by weight unless otherwise indicated. The abbreviation "®" stands for Registered Trade Mark.

Example 1

Cleaning Compositions/Formulations

The formulations are prepared for a leather cleaner/protectant.

| | Ingredients Weight % (product as supplied) | | | |
|---|---|---|---|---|
| | 1a | 1b | 1c | 1d |
| Dimethyl polysiloxane copolymer emulsion[1] | 2.0 (0.6-1.2) | 2.0 (0.6-1.2) | 2.0 (0.6-1.2) | 2.0 (0.6-1.2) |

-continued

| | Ingredients Weight % (product as supplied) | | | |
|---|---|---|---|---|
| | 1a | 1b | 1c | 1d |
| Amino substituted silicone copolymer emulsion[2] | 1.0 (0.1-0.3) | 1.0 (0.1-0.3) | 1.0 (0.1-0.3) | 1.0 (0.1-0.3) |
| C9-11 alcohol ethoxylate with 4 ethylene oxide units[3] | 5.0 (5.0) | 5.0 (5.0) | 5.0 (5.0) | 5.0 (5.0) |
| Sodium Acrylates Copolymer in Mineral Oil (and) PPG-1 Trideceth-6 (50% solids)[4] | 0.4 (0.2) | 0.4 (0.2) | 0.4 (0.2) | 0.4 (0.2) |
| Sodium Benzotriazolyl Butylphenol Sulfonate (and) Buteth-3 (and) Tributyl Citrate[5] | 0.10 (0.033) | 0.10 (0.033) | 0 | 0 |
| 2-(2-hydroxy-3-dodecyl-5-methylphenyl)-2H-benzotriazole[6] | 0 | 0.10 (0.10) | 0.15 (0.15) | 0.30 (0.30) |
| d-Limonine | 7.0 (7.0) | 7.0 (7.0) | 7.0 (7.0) | 7.0 (7.0) |
| Dipropylene glycol monomethylether[7] | 2.0 (2.0) | 2.0 (2.0) | 2.0 (2.0) | 2.0 (2.0) |
| Water | q.s. to 100 | q.s. to 100 | q.s. to 100 | q.s. to 100 |

Parentheses indicate the amount of active solids added to the formulation based on product assay.

[1]Commercially available from General Electric as GE SM2135. The composition of this material is: 1-5% sorbitan monolaurate, 30-60% dimethylpolysiloxane copolymer, 5-10% polyoxyethylene(20)sorbitan, 5-10% monoleate and the remaining portion is water.

[2]Commercially available from General Electric as GE SME 253. The composition of this material is: 1-5% C12-16 ethoxylated alcohol, 5-10% secondary alcohol, 10-30% aminopropylaminoethylpolysiloxane, 1-5% glycerine, 1-5% poly(oxy-1,2-ethanediyl) alpha tridecyl omega hydroxy and the remaining portion is water.

[3]Commercially available from Akzo Nobel as BEROL 260, 100% solids.

[4]Commercially available from Ciba Specialty Chemicals as RHEOVIS ADP, 50% solids.

[5]Commercially available from Ciba Specialty Chemicals as TINOGARD APA, 33% uv active solids.

[6]Commercially available from Ciba Specialty Chemicals as TINOGARD TL, 100% solids.

[7]Commercially available from Dow as DOWANOL DPM, 100% assay.

Example 2

Preparation of Premoistened Disposable Substrate (Wipes)

The formulations prepared in Example 1 are then applied to spunlace non-woven wipes. Each of the test solutions are spray applied to the lightweight fabric (spunlace non-woven supplied by AFG Wipes Inc.) with about 6 grams of solution added to about a 2 gram fabric swatch. Therefore, the loading on each wipe is about 300% based on initial dry weight of the untreated wipe.

Example 3

Application of Wipes on Leather Samples

Wipes are applied to the leather using a Gardener Scrub Tester in the following manner.

1. Leather samples (Brown NuBuck Leather) are placed on a Gardener Scrub
2. The cellulose sponges are wrapped with saran wrap and placed in the holder
3. The treated wipe is placed around the sponge in the holder
4. Gardner machine is set for four cycles
5. The sponge passes over the leather for four cycles
6. Measure sample

Example 4

Photostability Test: Accelerated Light Exposure Method and Color Change Measurement A Q-Sun accelerated weathering chamber is used to test the color change of the treated leather samples under UV light conditions at 340 nm in a Q-Sun Xe-3 Xenon Test Chamber.

Color Change Measurement

The treated leather samples are evaluated for total color change, Delta E, from measurements of the exposed area subtracted from measurements of the unexposed area. The color values are measured on a Datacolor Spectraflash SF650X spectrophotometer using D65 illuminant with 100 observer.

Delta E is calculated according to the following formula:

$$\text{Delta } E=[(L_f-L_i)^2+(a_f-a_i)^2+(b_f-b_i)^2]^{1/2}$$

f=final reading after weathering i=initial reading before weathering

Example 5

Color Change of Treated Leather after Weathering

| Formulation # | Delta E after four hours exposure |
|---|---|
| No treatment | 2.05 |
| 1a | 0.79 |
| 1d | 0.57 |
| 1b | 0.46 |

A lower Delta E value demonstrates less color change which is highly desirable. The results demonstrate that the wipe containing the cleaning composition wherein a mixture of UV absorbers is used gives surprisingly better results compared to a wipe containing only one UV absorber. The results additionally demonstrate that a wipe comprising a mixture of UV absorbers gives better results at a lower total UV absorber concentration compared to a wipe containing only one UV absorber wherein the total UV absorber is greater for the latter.

Example 6

Cleaning and Preserving Compositions/Formulations

The following formulations are prepared.

| | Ingredients Weight % (product as supplied) | | | | |
|---|---|---|---|---|---|
| | 6a | 6b | 6c | 6d | 6e |
| SURFONIC 24-12[1] | 2.0 (2.0) | 2.0 (2.0) | 2.0 (2.0) | 2.0 (2.0) | 2.0 (2.0) |
| Morpholine[2] | 1.0 (1.0) | 1.0 (1.0) | 1.0 (1.0) | 1.0 (1.0) | 1.0 (1.0) |
| SF96-350[3] | 5.0 | 5.0 | 5.0 | 5.0 | 5.0 |
| Sodium Benzotriazolyl Butylphenol Sulfonate (and) Buteth-3 (and) Tributyl Citrate[4] | 0.30 (0.099) | 0 | 0 | 0.15 (0.0495) | 0 |
| 2-(2-hydroxy-3-dodecyl-5-methylphenyl)-2H-benzotriazole[5] | 0 | 0.30 (0.30) | 0.15 (0.15) | 0.15 (0.15) | 0 |
| Oleic Acid[2] | 2.0 (2.0) | 2.0 (2.0) | 2.0 (2.0) | 2.0 (2.0) | 2.0 (2.0) |
| Mineral Spirits[2] | 7.0 (7.0) | 7.0 (7.0) | 7.0 (7.0) | 7.0 (7.0) | 7.0 (7.0) |
| Water | q.s. to 100 | q.s. to 100 | q.s. to 100 | q.s. to 100 | q.s. to 100 |
| Loading on wipe | 100% | 100% | 100% | 100% | 100% |

Parentheses indicate the amount of active solids added to the formulation based on product assay.

[1] $C_{14}$-$C_{15}$alkyl alcohol ethoxylated + 10 moles of ethylene oxide (EO) repeating units as a nonionic surfactant available from Huntsman, 100% solids.

[2] Available from Aldrich Chemical Company, 100% assay.

[3] Available from General Electric, dimethyl polysiloxane silicone fluid, molecular weight is approximately 13,700 Daltons, 100% assay.

[4] Commercially available from Ciba Specialty Chemicals as TINOGARD APA, 33% uv active solids, a water soluble uv absorber.

[5] Commercially available from Ciba Specialty Chemicals as TINOGARD TL, 100% solids, an oil soluble uv absorber.

Example 7

Preparation of Premoistened Disposable Substrate (Wipes)

The formulations prepared in Example 6 are then applied to spunlace non-woven wipes. Each of the test solutions are spray applied to the lightweight fabric (spunlace non-woven supplied by AFG Wipes Inc.) with about 2 grams of solution added to about a 2 gram fabric swatch.

Example 8

Application of Wipes on Leather Samples

Wipes prepared in Example 7 are applied to the leather by hand using 3 to 4 swipes.

Example 9

Color Change of Treated Leather after Weathering

The accelerated weathering method and tabulation of the results used in Example 9 are described in Example 4.

| Formulation # | Delta E after four hours exposure |
|---|---|
| No UV Absorber (6e) | 5.00 |
| 6c | 3.23 |
| 6b | 2.58 |
| 6a | 1.63 |
| 6d | 1.25 |

A lower Delta E value demonstrates less color change which is highly desirable. The results demonstrate that the wipe containing the cleaning composition wherein a mixture of UV absorbers is used gives surprisingly better results compared to a wipe containing only one UV absorber. The results additionally demonstrate that a wipe comprising a mixture of a water soluble UV absorber and an oil soluble UV absorber gives better results when compared to a wipe containing each UV absorber separately.

Example 10

Gloss Values of Treated Black Vinyl (Artifical Leather)

The formulations are prepared, applied to a black vinyl substrate using a premoistened, disposable cleaning wipe impregnated with the formulations below, the resulting gloss values are measured and the results are compared to commercially available wipes.

| | Ingredients Weight % (product as supplied) | |
|---|---|---|
| | 1b | 10a |
| Dimethyl polysiloxane copolymer emulsion[1] | 2.0 (0.6-1.2) | 2.0 (0.6-1.2) |
| Amino substituted silicone copolymer emulsion[2] | 1.0 (0.1-0.3) | 1.0 (0.1-0.3) |
| C9-11 alcohol ethoxylate with 4 ethylene oxide units[3] | 5.0 (5.0) | 1.0 (1.0) |
| Sodium Acrylates Copolymer in Mineral Oil (and) PPG-1 Trideceth-6 (50% solids)[4] | 0.4 (0.2) | 0.4 (0.2) |

-continued

| | Ingredients Weight % (product as supplied) | |
|---|---|---|
| | 1b | 10a |
| Sodium Benzotriazolyl Butylphenol Sulfonate (and) Buteth-3 (and) Tributyl Citrate[5] | 0.10 (0.033) | 0.10 (0.033) |
| 2-(2-hydroxy-3-dodecyl-5-methylphenyl)-2H-benzotriazole[6] | 0.10 (0.10) | 0.10 (0.10) |
| d-Limonine | 7.0 (7.0) | 4.0 (4.0) |
| Dipropylene glycol monomethylether[7] | 2.0 (2.0) | 2.0 (2.0) |
| Water | q.s. to 100 | q.s. to 100 |

Parentheses indicate the amount of active solids added to the formulation based on product assay.
[1]Commercially available from General Electric as GE SM2135. The composition of this material is: 1-5% sorbitan monolaurate, 30-60% dimethylpolysiloxane copolymer, 5-10% polyoxyethylene(20)sorbitan, 5-10% monoleate and the remaining portion is water.
[2]Commercially available from General Electric as GE SME 253. The composition of this material is: 1-5% C12-16 ethoxylated alcohol, 5-10% secondary alcohol, 10-30% amino-propylaminoethylpolysiloxane, 1-5% glycerine, 1-5% poly(oxy-1,2-ethanediyl) alpha tridecyl omega hydroxy and the remaining portion is water.
[3]Commercially available from Akzo Nobel as BEROL 260, 100% solids.
[4]Commercially available from Ciba Specialty Chemicals as RHEOVIS ADP, 50% solids.
[5]Commercially available from Ciba Specialty Chemicals as TINOGARD APA, 33% uv active solids.
[6]Commercially available from Ciba Specialty Chemicals as TINOGARD TL, 100% solids.
[7]Commercially available from Dow as DOWANOL DPM, 100% assay.

Each of the test formulations are spray applied to the light-weight fabric (spunlace non-woven supplied by AFG Wipes Inc.) with about 6 grams of solution added to about 2 gram fabric swatch.

Wipes are hand applied to the vinyl with 3 to 4 swiping motions.

The average gloss value from three separate locations is measured for each treated vinyl sample with a Minolta CM-2600 portable spectrophotometer with an 8° geometry. A greater or larger gloss value indicates a higher degree of gloss which is desirable.

| Formulation # | Gloss Value After Treatment |
|---|---|
| Alaab[1] | 13 |
| 10a | 15 |
| Weimans[2] | 17 |
| 1b | 23 |

[1]Commercially available leather wipe from Alaab - Car Protectant Wipe with UV Protectant.
[2]Commercially available leather wipes from Weimans.

The results surprisingly demonstrate that the wipe according to the instant invention improves the deposition of UV actives on the simulated leather, for example vinyl, and improves gloss.

What is claimed is:

1. A premoistened cleaning disposable substrate for cleaning leather surfaces, said substrate comprising:

a) a disposable substrate having incorporated therein an effective cleaning amount of b) a cleaning composition comprising i) from about 0.1% to about 3%, based on weight of the cleaning composition, of a mixture of polysiloxane copolymers of formula (III) and amino-substituted silicone copolymer derivatives of formula (IV)

(III)

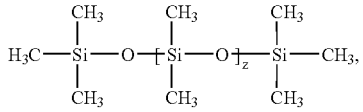

wherein z is an integer from 1 to about 5000;

(IV)

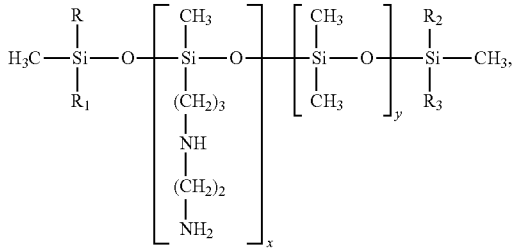

wherein

R, $R_1$, $R_2$ and $R_3$ independently from each other are $CH_3$, OH or $OC_1$-$C_4$alkyl;

x is an integer from 1 to 2000; and y is an integer from 1 to 2000;

ii) from about 0.25% to about 25%, based on weight of the cleaning composition, of at least one non-volatile organic solvent;

iii) optionally, from about 0% to about 15%, based on weight of the cleaning composition, of at least one detersive surfactant selected from the group consisting of cationic, zwitterionic, amphoteric, nonionic or mixtures thereof;

iv) from about 0.001% to about 15%, based on weight of the cleaning composition, of at least one cleaning polymer;

v) from about 0.001% to about 15%, based on weight of the cleaning composition, of at least two UV absorbers selected from a first UV absorber group and a second UV absorber group, wherein the first group is selected from the group consisting of 2,4,6-tris(2-hydroxy-4-octyloxyphenyl)-1,3,5-triazine;

2-(2,4-dihydroxyphenyl)-4,6-bis(2,4-dimethylphenyl)-1,3,5-triazine;

2,4-bis(2-hydroxy-4-propyloxyphenyl)-6-(2,4-dimethylphenyl)-1,3,5-triazine;

2-(2-hydroxy-4-octyloxyphenyl)-4,6-bis(4-methylphenyl)-1,3,5-triazine;

2-(2-hydroxy-4-dodecyloxyphenyl)-4,6-bis(2,4-dimethylphenyl)-1,3,5-triazine;

2-[2-hydroxy-4-(2-hydroxy-3-butyloxypropyloxy)phenyl]-4,6-bis(2,4-dimethylphenyl)-1,3,5-triazine;

2-[2-hydroxy-4-(2-hydroxy-3-octyloxypropyloxy)phenyl]-4,6-bis(2,4-dimethylphenyl)-1,3,5-triazine;

2-[2-hydroxy-4-(2-hydroxy-3-tridecyloxy-propyloxy) phenyl]-4,6-bis(2,4-dimethylphenyl)-1,3,5-triazine;

5-chloro-2-(2-hydroxy-3,5-di-tert-butylphenyl)-2H-benzotriazole;

2-(2-hydroxy-3-dodecyl-5-methylphenyl)-2H-benzotriazole;

5-chloro-2-(2-hydroxy-3-tert-butyl-5-methylphenyl)-2H-benzotriazole;

bis-(3-(2H-benzotriazol-2-yl)-2-hydroxy-5-tert-octyl) methane;
2-(2-hydroxy-3,5-di-tert-butylphenyl)-2H-benzotriazole;
2-(2-hydroxy-3,5-di-tert-amylphenyl)-2H-benzotriazole;
2-(2-hydroxy-3,5-di-alpha-cumylphenyl)-2H-benzotriazole;
2-(2-hydroxy-3-alpha-cumyl-5-tert-octylphenyl)-2H-benzotriazole;
2-(2-hydroxy-5-tert-octylphenyl)-2H-benzotriazole;
12-hydroxy-3,6,9-trioxadodecyl 3-tert-butyl-4-hydroxy-5-(2H-benzotriazol-2-yl)-hydrocinnamate;
octyl 3-tert-butyl-4-hydroxy-5-(2H-benzotriazol-2-yl)-hydrocinnamate;
4,6-bis(2,4-dimethylphenyl)-2-(4-(3-dodecyloxy*-2-hydroxypropoxy)-2-hydroxyphenyl)-s-triazine (* is mixture of $C_{12-14}$oxy isomers);
4,6-bis(2,4-dimethylphenyl)-2-(4-octyloxy-2-hydroxyphenyl)-s-triazine;
2,4-dihydroxybenzophenone;
2-hydroxy-4-octyloxybenzophenone;
2-hydroxy-4-dodecyloxybenzophenone;
2,4-dihydroxybenzophenone;
2,2',4,4'-tetrahydroxybenzophenone;
3-(4-imidazolyl)acrylic acid;
2-(2-hydroxy-5-methylphenyl)-2H-benzotriazole;
2,2'-dihydroxy-4,4'-dimethoxybenzophenone (Uvinul® 3049) and mixtures thereof;

and the second group is selected from the group consisting of 3-(2H-benzotriazol-2-yl)-4-hydroxy-5-(1-methylpropyl)-benzenesulfonic acid monosodium salt;
3-tert-butyl-4-hydroxy-5-(2H-benzotriazol-2-yl)-hydrocinnamic acid and sodium salt;
2,2'-dihydroxy-4,4'-dimethoxy-5,5'-disulfobenzophenone, disodium salt;
4-aminobenzoic acid;
2,3-dihydroxypropyl-4-aminobenzoic acid;
2-phenyl-5-benzimidazole sulfonic acid;
N,N,N-trimethyl-α-(2-oxo-3-bornylidene)-p-toluidinium methyl sulfate;
5-benzoyl-4-hydroxy-2-methoxybenzenesulfonic acid, sodium salt;
3-(4-benzoyl-3-hydroxyphenoxy)-2-hydroxy-N,N,N-trimethyl-1-propanaminium; chloride;
3-[4-(2H-benzotriazol-2-yl)-3-hydroxyphenoxy]-2-hydroxy-N,N,N-trimethyl-1-propanaminium;
chloride and mixtures thereof;

vi) from about 0.001% to about 20%, based on weight of the cleaning composition, of at least one wetting agent; and
vii) balance water;

with the proviso that said cleaning composition is essentially free of carbon-fluorine covalent bonds.

2. A premoistened cleaning disposable substrate according to claim 1, wherein component ii) is from about 0.5% to about 20%;
component iii) is from about 0.01% to about 10%;
component iv) is from about 0.01% to about 10%;
component v) is from about 0.01% to about 10%, based on weight of the cleaning composition, of the UV absorbers;
and
component vi) is from about 0.1% to about 15%.

3. A premoistened cleaning disposable substrate according to claim 2, wherein component ii) is from about 0.5% to about 10%;
component
iii) is from about 0.01% to about 5%;
component
iv) is from about 0.01% to about 8%;
component
v) is from about 0.1% to about 5%;
and
component
vi) is from about 0.1% to about 10%.

4. A premoistened cleaning disposable substrate according to claim 3, wherein component ii) is from about 1% to about 5%;
component
iii) is from about 0.01% to about 1%;
component
iv) is from about 0.01% to about 5%;
component
v) is from about 0.1% to about 2%;
and
component
vi) is from about 1% to about 10%.

5. A premoistened cleaning disposable substrate according to claim 1 wherein said substrate of component a) is a single-layered structure or is a multilayered laminate-type structure.

6. A premoistened cleaning disposable substrate according to claim 1 wherein component b) i) comprises a mixture of polysiloxane copolymers of formula (III) and amino-substituted silicone copolymer derivatives of formula (IV) wherein (III)

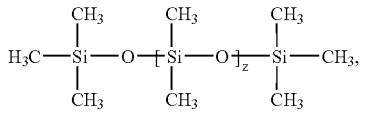

wherein
z is an integer from 1 to about 5000;

(IV)

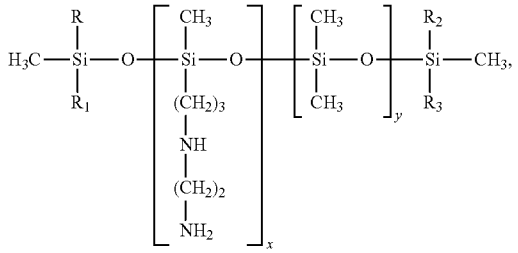

wherein
R, $R_1$, $R_2$ and $R_3$ are $CH_3$;
x is an integer from 1 to 2000; and
y is an integer from 1 to 2000.

7. A premoistened cleaning disposable substrate according to claim 1 wherein said cleaning composition is present in said substrate in a concentration from about 50 percent to about 1000 percent based on weight relative to the weight of the dry substrate.

8. A premoistened cleaning disposable substrate according to claim 7 wherein said cleaning composition is present in said substrate in a concentration from about 200 percent to about 800 percent based on weight relative to the weight of the dry substrate.

9. A premoistened cleaning disposable substrate according to claim 8 wherein said cleaning composition is present in said substrate in a concentration from about 200 percent to about 500 percent based on weight relative to the weight of the dry substrate.

10. A premoistened cleaning disposable substrate according to claim 1 wherein said substrate is a cleaning wipe.

11. A premoistened cleaning disposable substrate according to claim 1 wherein the second UV absorber is selected from the group consisting of 3-(2H-benzotriazol-2-yl)-4-hydroxy-5-(1-methylpropyl)-benzenesulfonic acid monosodium salt;

2,2'-dihydroxy-4,4'-dimethoxy-5,5'-disulfobenzophenone, disodium salt;

2-phenyl-5-benzimidazole sulfonic acid;

5-benzoyl-4-hydroxy-2-methoxybenzenesulfonic acid, sodium salt;

and mixtures thereof.

12. A premoistened cleaning disposable substrate according to claim 11 wherein the first UV absorber is selected from the group consisting of 5-chloro-2-(2-hydroxy-3,5-di-tert-butylphenyl)-2H-benzotriazole;

2-(2-hydroxy-3-dodecyl-5-methylphenyl)-2H-benzotriazole;

5-chloro-2-(2-hydroxy-3-tert-butyl-5-methylphenyl)-2H-benzotriazole;

bis-(3-(2H-benzotriazol-2-yl)-2-hydroxy-5-tert-octyl) methane;

2-(2-hydroxy-3,5-di-tert-butylphenyl)-2H-benzotriazole;

2-(2-hydroxy-3,5-di-tert-amylphenyl)-2H-benzotriazole;

2-(2-hydroxy-3,5-di-alpha-cumylphenyl)-2H-benzotriazole;

2-(2-hydroxy-3-alpha-cumyl-5-tert-octylphenyl)-2H-benzotriazole;

2-(2-hydroxy-5-tert-octylphenyl)-2H-benzotriazole and 2-(2-hydroxy-5-methylphenyl)-2H-benzotriazole;

and the second UV absorber is 3-(2H-benzotriazol-2-yl)-4-hydroxy-5-(1-methylpropyl)-benzenesulfonic acid monosodium salt;

2,2'-dihydroxy-4,4'-dimethoxy-5,5'-disulfobenzophenone, disodium salt;

5-benzoyl-4-hydroxy-2-methoxy-benzenesulfonic acid, sodium salt;

or mixtures thereof.

13. A premoistened cleaning disposable substrate according to claim 12 wherein the second UV absorber is 3-(2H-benzotriazol-2-yl)-4-hydroxy-5-(1-methylpropyl)-benzenesulfonic acid monosodium salt.

14. A premoistened cleaning disposable substrate according to claim 13, wherein the first UV absorber is 2-(2-hydroxy-3-dodecyl-5-methylphenyl)-2H-benzotrazole.

* * * * *